US012173245B2

(12) United States Patent
Sumant et al.

(10) Patent No.: US 12,173,245 B2
(45) **Date of Patent: *Dec. 24, 2024**

(54) ROBUST SUPERLUBRICITY WITH STEEL SURFACES IN SLIDING CONTACTS

(71) Applicant: UCHICAGO ARGONNE, LLC, Chicago, IL (US)

(72) Inventors: Anirudha V. Sumant, Plainfield, IL (US); Venkata Aditya Ayyagari, Darien, IL (US)

(73) Assignee: UChicago Argonne, LLC, Chicago, IL (US)

( * ) Notice: Subject to any disclaimer, the term of this patent is extended or adjusted under 35 U.S.C. 154(b) by 407 days.

This patent is subject to a terminal disclaimer.

(21) Appl. No.: 17/351,817

(22) Filed: Jun. 18, 2021

(65) Prior Publication Data

US 2023/0272296 A1 Aug. 31, 2023

(51) Int. Cl.
*C10M 103/06* (2006.01)
*C10M 103/02* (2006.01)
(Continued)

(52) U.S. Cl.
CPC ..... *C10M 103/06* (2013.01); *C10M 103/02* (2013.01); *C10M 2201/0413* (2013.01); *C10M 2201/0663* (2013.01); *C10N 2040/02* (2013.01); *C10N 2040/12* (2013.01); *C10N 2040/18* (2013.01); *C10N 2040/24* (2013.01); *C10N 2040/30* (2013.01); *C10N 2040/50* (2020.05); *C10N 2050/08* (2013.01); *C10N 2070/00* (2013.01)

(58) Field of Classification Search
CPC ..... C10M 103/06; C10M 103/02; C10M 2201/0413; C10M 2201/0663; C10N 2040/50; C10N 2040/02; C10N 2040/12; C10N 2040/18; C10N 2040/24; C10N 2040/30; C10N 2050/08; C10N 2070/00
See application file for complete search history.

(56) References Cited

U.S. PATENT DOCUMENTS 3,638,308 A 2/1972 Fischbein et al.
3,774,703 A 11/1973 Sanderson
(Continued)

FOREIGN PATENT DOCUMENTS

CN 102627993 A 8/2012
CN 106398802 A 2/2017
(Continued)

OTHER PUBLICATIONS

International Search Report & Written Opinion for Int'l Patent App. No. PCT/US2022/015911 dated Jul. 6, 2022, 13 pages.
(Continued)

*Primary Examiner* — Vishal V Vasisth
(74) *Attorney, Agent, or Firm* — Foley & Lardner LLP

(57) ABSTRACT

A low friction wear surface with a coefficient of friction in the superlubric regime under a sliding and rolling movement. The low friction wear surface includes molybdenum disulfide and graphene oxide on a first wear surface with a tribolayer formed on a rough steel counter surface during the sliding and rolling movement. Methods of producing the low friction wear surface are also provided.

20 Claims, 22 Drawing Sheets

(51) Int. Cl.

| | |
|---|---|
| *C10N 40/00* | (2006.01) |
| *C10N 40/02* | (2006.01) |
| *C10N 40/12* | (2006.01) |
| *C10N 40/18* | (2006.01) |
| *C10N 40/24* | (2006.01) |
| *C10N 40/30* | (2006.01) |
| *C10N 50/08* | (2006.01) |
| *C10N 70/00* | (2006.01) |

(56) References Cited

U.S. PATENT DOCUMENTS

| | | | |
|---|---|---|---|
| 5,462,362 | A | 10/1995 | Yuhta et al. |
| 5,538,649 | A | 7/1996 | Demendi et al. |
| 5,922,418 | A | 7/1999 | Koike et al. |
| 6,273,973 | B1 | 8/2001 | Parayil et al. |
| 8,222,190 | B2 | 7/2012 | Zhamu et al. |
| 9,914,152 | B2 | 3/2018 | Beckford et al. |
| 11,155,762 | B2 | 10/2021 | Sumant et al. |
| 2006/0172897 | A1 | 8/2006 | Yamamoto |
| 2007/0158609 | A1 | 7/2007 | Hong et al. |
| 2008/0116011 | A1 | 5/2008 | Takahama et al. |
| 2008/0302998 | A1 | 12/2008 | Hong et al. |
| 2009/0033164 | A1 | 2/2009 | Khan |
| 2010/0011826 | A1 | 1/2010 | Buehler et al. |
| 2010/0087346 | A1 | 4/2010 | Giesler et al. |
| 2010/0173134 | A1 | 7/2010 | Khokhlov et al. |
| 2011/0046027 | A1 | 2/2011 | Zhamu et al. |
| 2012/0115761 | A1 | 5/2012 | Basu |
| 2012/0118255 | A1 | 5/2012 | Jung et al. |
| 2012/0122743 | A1 | 5/2012 | Ivanov et al. |
| 2012/0204429 | A1 | 8/2012 | Vlachos et al. |
| 2013/0015409 | A1 | 1/2013 | Fugetsu |
| 2013/0115462 | A1 | 5/2013 | Mazyar et al. |
| 2013/0126865 | A1 | 5/2013 | Chiang et al. |
| 2013/0190449 | A1 | 7/2013 | Kinloch et al. |
| 2013/0324447 | A1 | 12/2013 | Tsou et al. |
| 2014/0291819 | A1 | 10/2014 | Barth |
| 2015/0197701 | A1 | 7/2015 | Sumant et al. |
| 2015/0367381 | A1 | 12/2015 | Sumant et al. |
| 2016/0325994 | A1 | 11/2016 | Qu et al. |
| 2018/0223208 | A1 | 8/2018 | Sumant et al. |
| 2018/0229384 | A1 | 8/2018 | Chadwick et al. |
| 2018/0251641 | A1 | 9/2018 | Vasileiou et al. |
| 2019/0039028 | A1 | 2/2019 | Wanunu et al. |
| 2021/0095218 | A1* | 4/2021 | Sumant ..... C10M 103/06 |

FOREIGN PATENT DOCUMENTS

| | | | |
|---|---|---|---|
| CN | 108251195 | A | 7/2018 |
| JP | 2012-037035 | A | 2/2012 |
| RU | 2310777 | C2 | 11/2007 |
| WO | WO-2010/125059 | A1 | 11/2010 |
| WO | WO-2011/081538 | A1 | 7/2011 |
| WO | WO-2012/046069 | A1 | 4/2012 |
| WO | WO-2017/032985 | A1 | 3/2017 |

OTHER PUBLICATIONS

Tran, "Surface Metrology: Stylus and white light interferometry," Sandia National Laboratories NCSLI Albuquerque Section Meeting, 32 pages (2012).

Babuska, et al., "Understanding Friction in MoS2: Part 1: Stress, Time and Temperature," 63rd AVS Symposium, SAND2017-5129C, 15 pages (2017).

Berman, et al,. "Operando tribochemical formation of onion-like-carbon leads to macroscale superlubricity," Nature Communications 9, 1164, 9 pages (2018).

Berman, et al., "Macroscale superlubricity enabled by graphene nanoscroll formation," Science 348(6239), pp. 1118-1122 (2015).

Buckley, "Friction, wear, and lubrication in vacuum," NASA Technical Report No. NASA-SP-277, 190 pages (1971).

Cummings & Zettl, "Low-Friction Nanoscale Linear Bearing Realized from Multiwall Carbon Nanotubes," Science 289(5479), pp. 602-604 (2000).

Dienwiebel, et al., "Superlubricity of Graphite," Physical Review Letters 92(12), 126101, 4 pages (2004).

Fundus & Knock, "Diamond Like Carbon Coatings—Tribological Possibilities And Limitations In Applications On Sintered Silicon Carbide Bearing And Seal Faces," Proceedings of the 14th International Pump Users Symposium, pp. 93-98 (1997).

Hamilton, et al., "A Possible Link Between Macroscopic Wear and Temperature Dependent Friction Behaviors of MoS2 Coatings," Tribology Letters 32, pp. 91-98 (2008).

Hare & Burris, "The Effects of Environmental Water and Oxygen on the Temperature-Dependent Friction of Sputtered Molybdenum Disulfide," Tribology Letters 52(3), pp. 485-493 (2013).

International Search Report & Written Opinion for PCT/US20013/051121 dated Nov. 14, 2013, 8 pages.

Kanazawa, et al., "Studies of Friction in Grease-Lubricated Rolling Bearings Using Ball-on-Disc and Full Bearing Tests," Tribology Transactions 63(1), pp. 77-89 (2020).

Kim, et al., "Chemical Vapor Deposition-Grown Graphene: The Thinnest Solid Lubricant," ACS Nano 5(6), pp. 5107-5114 (2011).

Kim, et al., "Chemical Vapor Deposition-Grown Graphene: The Thinnest Solid Lubricant," ACS Nano 5, pp. 5107-5114 (2014).

Kimura, et al., "Boron nitride as a lubricant additive," Wear 232(2), pp. 199-206 (1999).

Lee, et al., "Frictional Characteristics of Atomically Thin Sheets," Science 328(5974), pp. 76-80, (2010).

Liu, Z., et al., "Observation of Microscale Superlubricity in Graphite", Physical Review Letters, May 18, 2012, 108:205503-1-205503-5.

Novoselov, et al., "Electric Field Effect in Atomically Thin Carbon Films," Science 306(5696), pp. 666-669 (2004).

Podgornik, et al., "Tribological behaviour and lubrication performance of hexagonal boron nitride (h-BN) as a replacement for graphite in aluminium forming," Tibology International 81, pp. 267-275 (2015).

Singh, et al., "Fatigue resistant carbon coatings for rolling/sliding contacts," Tribology International 98, pp. 172-178 (2016).

Singhbabu, et al., "Efficient anti-corrosive coating of cold-rolled steel in a seawater environment using an oil-based graphene oxide ink," Nanoscale 7(17), pp. 8035-8047 (2015).

Stankovich, et al., "Synthesis of graphene-based nanosheets via chemical reduction of exfoliated graphite oxide," Carbon 45(7), pp. 1558-1565 (2007).

Sumant, et al., "Ultrananocrystalline Diamond Film as a Wear-Resistant and Protective Coating for Mechanical Seal Applications," Tribology Transactions 48(1), pp. 24-31 (2005).

Wu, et al., "Tribological behavior of WC/DLC/WS2 nanocomposite coatings," Surface and Coatings Technology 188-189, pp. 605-611 (2004).

Wu, et al., "Experimental analysis of tribological properties of lubricating oils with nanoparticle additives," Wear 262(7-8), pp. 819-825 (2007).

Yu, et al., "Graphene segregated on Ni surfaces and transferred to insulators," Applied Physics Letters 93, 113103, 4 pages (2008).

* cited by examiner

| Test # | Load (N) | Rolling Speed (mm/s) | SRR (%) | Test Distance (km) |
|---|---|---|---|---|
| 1 | 30 | 100 | 2 | 1.4 |
| 2 | 30 | 100 | 5 | 1.4 |
| 3 | 30 | 100 | 7 | 1.4 |
| 4 | 30 | 500 | 2 | 1.4 |
| 5 | 30 | 500 | 5 | 1.4 |
| 6 | 30 | 500 | 7 | 1.4 |
| 7 | 30 | 100 | 5 | 70.0 |

FIG. 3

Coating deformation

Wear on Steel: 1.4 km sliding

Wear on Steel: 70 km sliding

5% SRR: Spread-out $MoS_2$ flake and GO + amorphous carbon on disc

5% SRR: Amorphous carbon and $MoS_2$ flakes on ball

High-resolution image

SAED Pattern

EELS

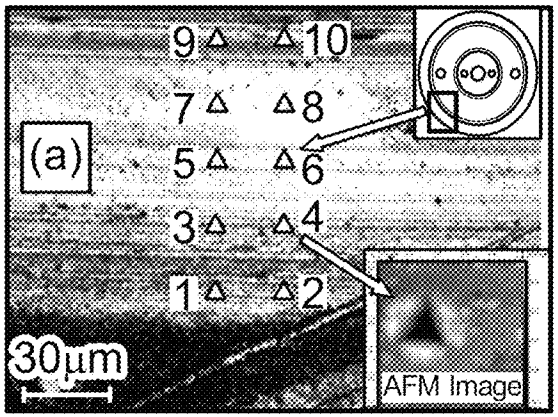
FIG. 12A
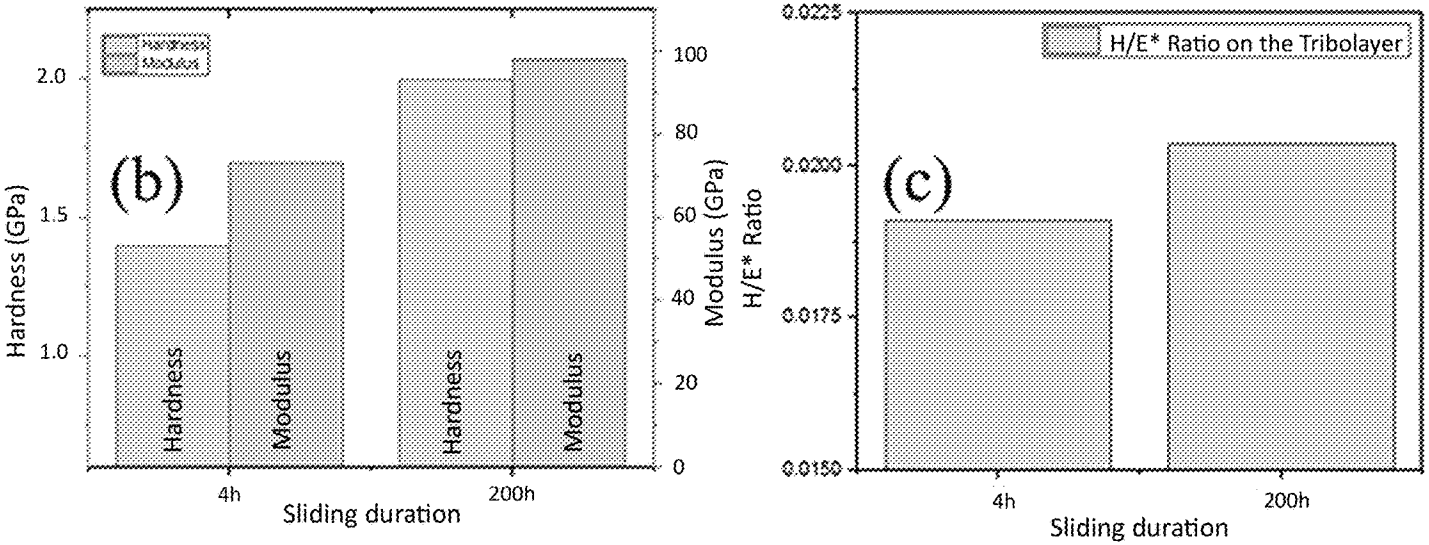
FIG. 12B
FIG. 12C

ROBUST SUPERLUBRICITY WITH STEEL SURFACES IN SLIDING CONTACTS

STATEMENT REGARDING FEDERALLY SPONSORED RESEARCH

This invention was made with government support under Contract No. DE-AC02-06CH11357 awarded by the U.S. Department of Energy, Office of Science, Office of Basic Energy. The United States government has certain rights in this invention.

BACKGROUND

Friction is a well-known problematic aspect of a number of important mechanical systems in the modern world. Friction occurs in many varied situations and not all lubrication schemes will function in every situation. Regardless of the situation, a frequently desired outcome is to reduce friction as much as practical. As such, much effort has been expended to design, manufacture, and operate moving mechanical assemblies (MMAs) in a drastically reduced or ideally in a superlubricious environment. The superlubric regime is attractive because it would provide the highest levels of savings in energy, environment, and money.

Despite the development and use of many kinds of solid and liquid lubricants in recent years, superlubricity is seldom achieved at macro or engineering scales. Generally, friction coefficients of less than 0.01 are considered superlow, and hence fall in the superlubric regime. While superlubric regimes have been developed for some applications, such as for surfaces that are either aero- or hydro-dynamically separated or magnetically levitated where little or no solid-to-solid contact takes place, not all applications can take advantage of such previously developed schemes. For example, sliding regimes where direct metal-to-metal contacts prevail and high contact pressures are present, present a challenge not present in the aero- or hydro-dynamically separated applications. Thus, achieving superlubric friction coefficients (i.e., less than 0.01) is difficult due to the concurrent and often very complex physical, chemical, and mechanical interactions taking place at sliding surfaces.

In fact, a large portion of these losses are found in machine systems, such as sliding and/or rolling contacts, where hardened metal-on-metal surfaces rub against each other.

Traditionally, organic, synthetic, and mineral oils have been in use to reduce wear and frictional energy loss in mechanical components in contact. In these contacts, both the viscosity of the oil-based lubricant, as well as the lubricant additives, play an important role in reducing frictional losses. It is well known that oil-based lubricants themselves experience internal friction (traction) as they shear between sliding parts. Because of this, lubricant additives, such as viscosity and surface modifiers, are often used to reduce energy losses. Further, such systems suffer from a failure mechanism where if the viscosity of the oil drops too low, or if the surface modifiers are removed, metal-on-metal contact can occur without the benefit of the lubrication regime. This reliance on liquid lubricants in a contact-passed applications causes increased risk of a failure event when temperature or pressures exceed threshold values.

While there have been several technological developments in the past decade that effectively reduce friction and prolong life of lubricant oils. Although these techniques have been somewhat effective, a major drawback is that all aforementioned deposition techniques inherently suffer from a limitation in both the size and complexity of the components, which provides severe limitations for some applications. Oil-based or coatings-based technologies fall short of superlative performance in several applications where desired friction is below 0.01.

Macroscopic superlubricity under pure sliding was demonstrated using 2D materials by Berman, et al., with graphene in a groundbreaking discovery. However, this discovery requires one surface to be coated in diamond-like carbon (DLC) and was shown to be operative in pure sliding (pin-on-disc) tests.

While $MoS_2$-Graphene in rolling-sliding contacts has shown some positive results for producing superlubricity, such reports have relied upon either fine (surface roughness ($R_a$): ~100 nm) or super-fine ($R_a$<100 nm) polished surfaces. Unfortunately, these condition requirements are not viable for a range of applications using an industrially relevant rough surface finish ($R_a$ of ~300 nm or above). In particular, the roughness of the surface and the interplay of increasing pressure and or velocity magnifies the distinction between the prior reports using relative fine (smooth) surfaces rather than a rougher surface. Thus, a need remains for robust solid lubricants that can perform on rough surfaces under bearing and or gear contact conditions.

SUMMARY

One embodiment relates to a method of forming a low friction wear surface comprising disposing over a substrate a solution comprising molybdenum disulfide ($MoS_2$) and graphene oxide (GO) to form a first sliding component; moving the first sliding component against a steel component, the steel component comprising stainless steel; and forming an impervious tribolayer on the steel component.

One embodiment relates to a low friction wear surface. The low friction wear surface comprising a substrate; and molybdenum disulfide ($MoS_2$) and graphene oxide (GO) disposed over the substrate, wherein interaction between the low friction wear surface and a stainless steel countersurface forms an impervious tribolayer on the low friction wear surface.

One embodiment relates a method of forming a low friction wear surface comprising suspending solid components in a solvent to form a solution of at least 1 g/L; depositing the solution on a substrate in a dry, inert environment; and evaporating the solvent and forming a coating of the solid components.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 3 shows a plot of testing parameters of seven tests conducting according to the present disclosure.

FIG. 4A plots coefficient of friction for a slide-to-roll ratio of 2%, FIG. 4B plots coefficient of friction for a slide-to-roll ratio of 5%, and FIG. 4C plots coefficient of friction for a slide-to-roll ratio of 7%. FIG. 4D is a summary plot that tracks coefficient of friction as a function of slide-to-roll ratio for different speeds.

FIG. 12A is a scanning electron microscope (SEM) image of tribolayer showing location of nanoindentations. FIG. 12B shows the hardness and modulus of the nanoindentations on the tribolayer after 1.4 km and 70 km tests. FIG. 12C shows a hardness-to-modulus ratio of the tribolayer after 1.4 km and 70 km tests.

DETAILED DESCRIPTION

Following below are more detailed descriptions of various concepts related to, and embodiments of, robust superlubricity between steel surfaces in sliding contact via a solid lubricant. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Described herein are systems and methods for robust solid lubricants that can perform on rough surfaces ($R_a$ of ~200~350 nm) under bearing and or gear contact conditions, the systems and methods described herein are directed to a new solid lubricant in state-of-the-art rolling sliding equipment. Generally speaking, the various embodiments described herein include a one-step processing technique and solid-lubricant material combination that is shown to produce superlubricity in rolling-sliding conditions. Rolling-sliding or rolling interfaces include, but are not limited to, gears and other mechanical components. Gears operating under high loads fail due to the high contact pressures that cause a variety of failures such as surface fatigue, contact fatigue, and micro-pitting, all of which stem from high friction and subsequent temperature generation, and are mitigated by amble lubrication in the gears and tribological system.

In some embodiments, the low friction wear surface includes a 2D material and nanoparticles (or other counter surface) as a solid lubricant. The wear surface may exhibit superlubricity through tribological interaction between surfaces that causes phase transformation of GO to amorphous carbon and extended shearing of $MoS_2$. Furthermore, the longevity of the coating can be attributed to the perpetual compaction of the constituent phases. In certain embodiments, the material being lubricated is steel, for example a steel-on-steel contract such as a pair of gears, with the described solid lubricants deposited on the steel (as a face and counter-face pair).

Figure 1:
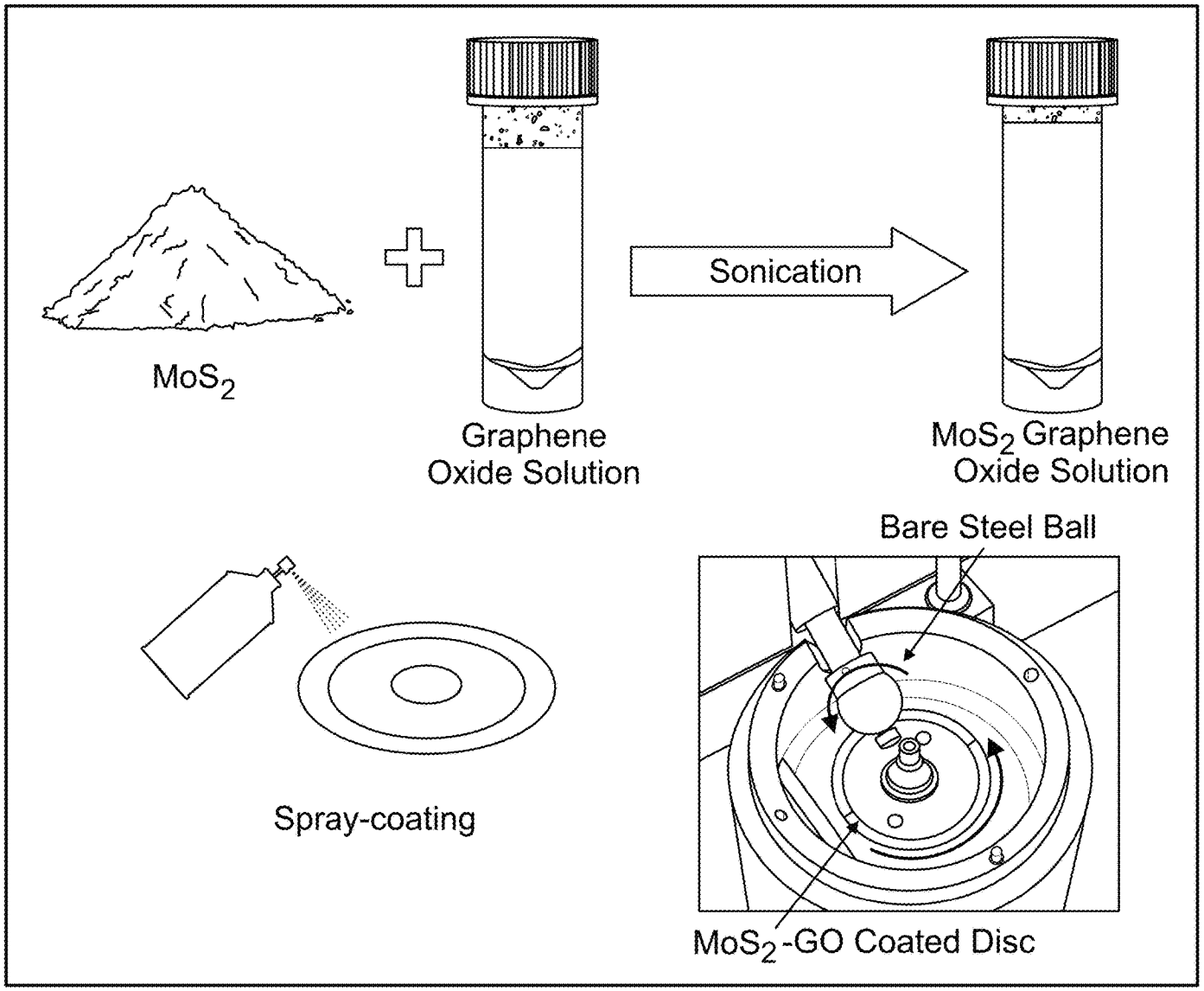
FIG. 1 is a schematic of preparing a solid lubricant, spray coating a steel substrate, and setting-up a mini-traction machine test.

In a first embodiment, solid lubricants are applied to a surface of steel samples using a suspension processing method called "Sonix." FIG. 1 shows a schematic for Sonix, according to the first embodiment. As shown in FIG. 1, the suspension is created by mixing 1:1 (up to ±20%, for example 2:3 ratio to 3:2 ratio) weight ratio of $MoS_2$ and GO in a carrier media or solvent (e.g., ethanol or water), which is sequentially tumbled and sonicated alternatively to obtain a homogenous suspension with no solid material setting down for at least 24 hours. In one embodiment, the functionality is believed to be unaffected up to 20% in variation of the resultant solid lubricious composition. The effective concentration of the solid components in the solvent is between 1-10 g/L, such as 1-2 g/L; in an example embodiment, the effective concentration is about 2 g/L. After ensuring that the solids are fully suspended in ethanol, the suspension is sprayed onto steel substrates in multiple layers. Multiple layers maybe deposited by allowing a liquid coating to dry, leaving the dispersed solids, and applying a new liquid coating of the suspension. This process may be repeated to a desired thickness of solid coating. In one embodiment, the temporal spacing between deposition of one coating of the suspension and a subsequent coating is 2-10 seconds. Further, the drying of a deposited suspension coating may be achieved a circulation of air, such as dry nitrogen, to accelerate the evaporation of the liquid phase of the suspension, such as ethanol. The coating thickness is a minimum of 100-2000 nm.

In one embodiment, tribological system comprises a first object, such as a sliding component, comprising steel coated with a $MoS_2$-GO solid lubricant having a thickness of 100-2000 nm. A second object, such as a steel component, serving as a counter-surface for the first object during SRR, comprises steel. In an alternative embodiment, a second object comprising steel coated with a $MoS_2$-GO solid lubricant having a thickness of 100-2000 nm. The counter surface, the "ball" in experimental examples using such, is uncoated in some embodiments. That is, the counter surface need not have a lubricious material, rather it may be, at the start of a use cycle, material such as steel or in the alternative materials such as a ceramics. In some embodiments, the counter surface may be $WS_2$ or $Si_3$ $N_4$. The steel substrates of the first and second objects have surface roughness of $R_a$ ($R_a$ of ~200~350 nm. In one embodiment, the steel substrate has a roughness of $R_a$ 300±20 nm. In another embodiment, the steel substrate has a surface roughness of $R_a$ 215±15 nm.

The first object and the second object undergo a sliding and rolling relative mechanical communication with each other, where the slide-to-roll ratio is 2-7%, at a velocity of 100 mm/s to 1000 mm/s, at a pressure of 1 Gpa to 1.75 Gpa at temperatures in the range of room temperature (20-25° C.) to 300° C. This mechanical interaction of the first object and the second object results in the formation of a tribolayer on the second object. The tribolayer is formed from materials, $MoS_2$ and/or GO, from the coating on the first object. It is believed that the tribolayer is formed of amorphous carbon from the GO or from the shearing of the $MoS_2$, resulting in the formation on the second object where the coating of the first object and the second object physically contact. In some embodiments, scrolling of the tribolayer does not occur, rather only amorphous carbon formation on the counter surface. The tribological system exhibits a coefficient of friction of less than about 0.01. While the overall performance of this tribo-pair of first object and second object is characterized as performing in the superlubric regime, it is believed that there is a balance between SRR-induced lubricity mechanism and shear-rupture that resulted in the local depression in friction. As discussed with regard the experimental examples, the friction in the pairing reduces over time. A short break in period, relative to expectations for prior lubricious materials, is observed. Following the break-in period, a superlubricious state is reached and has been observed, as seen in FIG. 3 and compared to FIGS. 7A-7C, extending for 8 days, equating to over 70 km of linear sliding. As discussed in the Examples below, particularly with regard to the results illustrated in FIGS. 12A-12C, the densification and compacting of the coating is believed to contribute to the improved hardness and wear resistance to maintain the superlubricity.

EXAMPLES

Solid lubricants are deposited by Sonix as described above. The solid lubricants are deposited on steel substrates made of 52100 steel in hardened and tempered condition, with a surface roughness of $R_a$ 215±20 nm. Successive coating passes are spaced out in time such that the preceding coating is fully dry from evaporation of the ethanol (e.g., 2-10 seconds between coatings). A uniform dispersion rate and pass-to-pass delay are tuned such that the ethanol immediately evaporates upon contacting the surface, effectively transferring the homogenous solid mixture.

Figures 2A, 2B, 2C:
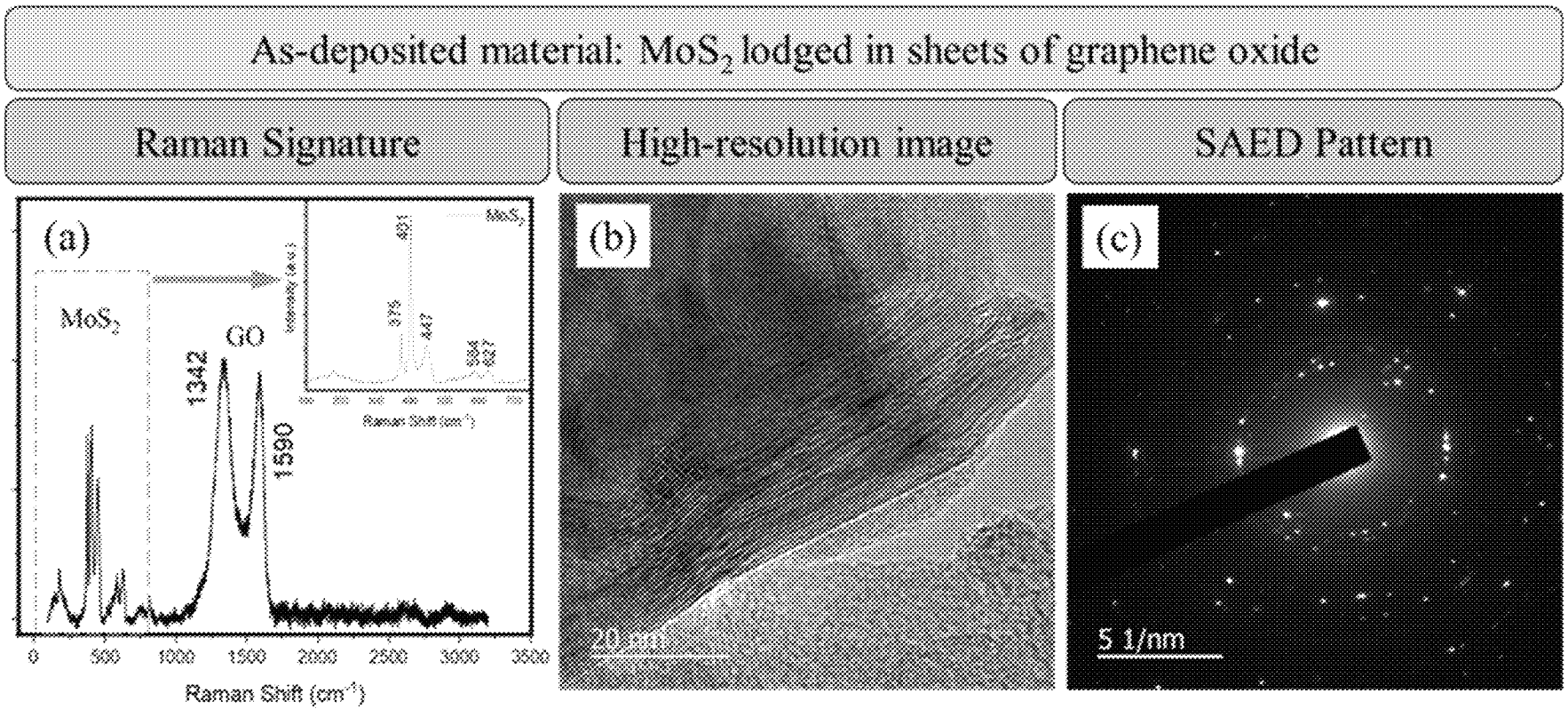
FIG. 2A is a Raman spectra of the as-deposited solid lubricant.
FIG. 2B is a bright-field transmission electron microscopy (TEM) image of the as-deposited solid lubricant.
FIG. 2C is a diffraction pattern of the as-deposited solid lubricant.

In order to record a thickness of a coating of the new solid lubricant on samples, a small area is cleaned out with a sharp scribe, and the height different is record at 1.2±0.01 μm at multiple locations. A small sample from the as-deposited coating is taken and analyzed for its microstructure and chemical signature in the starting (i.e., pristine) condition. FIG. 2A shows Raman spectra obtained from the sample. As shown in FIG. 2A, the Raman signature shows distinct, clear, and strong peaks from both individual phases (i.e., $MoS_2$ and GO). FIG. 2B shows a bright-field TEM image of the coating. As shown in FIG. 2B, the aforementioned phases are distinctly identified by their lattice parameters. FIG. 2C shows the selected area electron diffraction (SAED) image. As shown in FIG. 2C, the presence of two interpenetrating phases possessing classical hexagonal diffraction patterns is confirmed.

All experiments described herein are conducted on a PCS Instruments Mini-Traction Machine (MTM). The MTM utilizes a ½" diameter ball on disc contact to simulate variable contact conditions with programmable levels of rolling speed, load, and slip. This testing chamber is shown in FIG. 1. The specimens are assembled in the chamber (i.e., following the above Sonix method), and then the chamber is covered and purged with nitrogen for a minimum of 30 minutes in order to ensure a 99.9996% pure dry nitrogen testing environment. While the test is running, a constant supply of 5-10 centiliters$^3$/s of nitrogen is supplied to the test chamber. Although the chamber itself is not perfectly sealed, the continuous supply of nitrogen is sufficient to ensure that no air is able to flow into the test chamber over the entirety of the testing period. Prior to conducting any tests, a 30 minute run consisting of a load ramp from 2 N to 30 N (i.e., 1.0 GPa max stress) is conducted on each sample.

In total, seven tests are conducted, and are intended to study the effect of a variable slide-to-roll ratio (SRR), rolling speed, and test duration on friction and superlubricity. SRR is defined as a ratio of the sliding speed of one object with a first surface to the mean rolling speed for the two objects with the first surface and a second surface (i.e., the average of the rotational speeds of both objects). For example, if the two surfaces in rolling-sliding contact are a ball along a table, the sliding speed is the speed at which the ball is moving horizontally and the mean rolling speed is an average of the rotational speed of the ball and of the table. In another example in which the two surfaces are gears, the sliding speed is the speed at which the first gear is moving around the second, and the mean rolling speed is an average of the rotational speed of the first gear and of the second gear. The SRR is therefore determined according to the following formula:

$$SRR = \left(\frac{2(\text{Velocity}_{Ball} - \text{Velocity}_{Disk})}{(\text{Velocity}_{Ball} + \text{Velocity}_{Disk})}\right) \cdot 100$$

FIG. 3 is a table showing testing values for each of the 7 tests performed according to the above conditions.

Figure 4A:
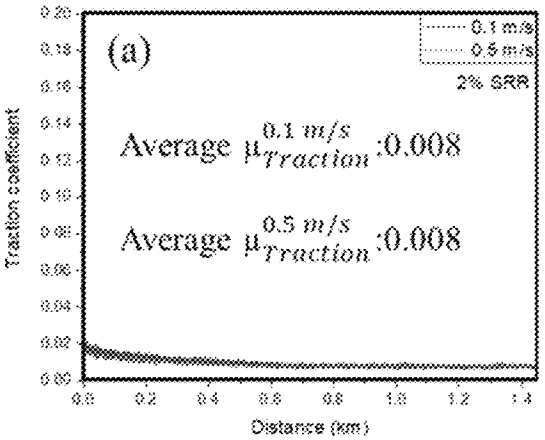
FIGS. 4A-4D show plots of coefficients of friction as measured according to various slide-to-roll ratios.
Figure 4B:
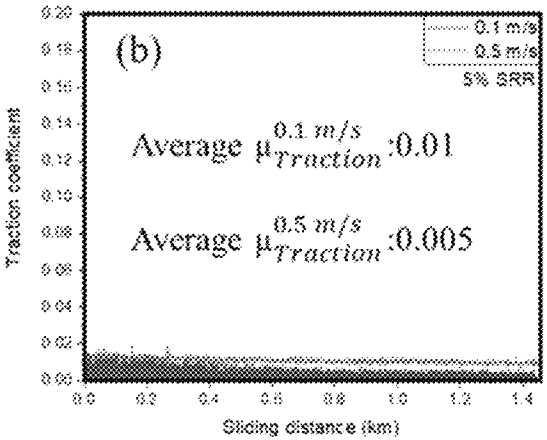
Figure 4C:
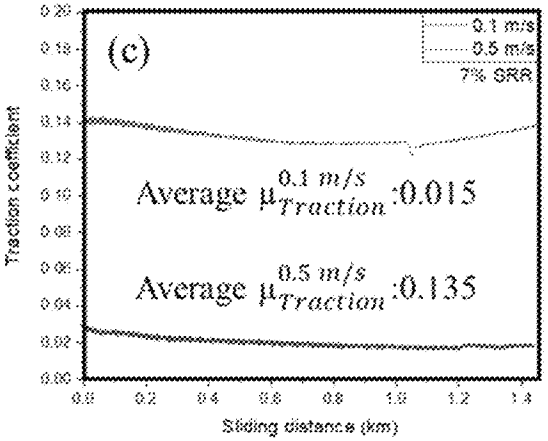
Figure 4D:
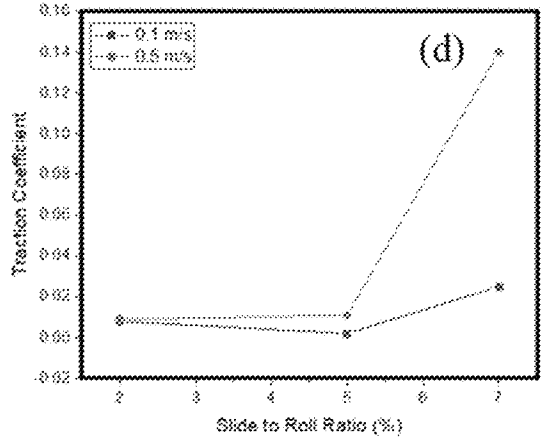

FIGS. 4A-4D show plots of data indicative of a coefficient of friction measured at various slide-to-roll ratios (SRR). FIG. 4A shows data for a SRR of 2%, FIG. 4B shows data for a SRR of 5%, FIG. 4C shows data for a SRR of 7%, and FIG. 4D shows data indicative of the variation in friction coefficient as a function of SRR. As shown in FIG. 4A, with 2% SRR at 0.1 m/s and 0.5 m/s sliding speed, an average traction coefficient is 0.008. As shown in FIG. 4B, the friction coefficient was observed to remain substantially stable at 0.009 at 5% SRR, but increased by 65% to 0.015 at 7% SRR, as shown in FIG. 4C. The lowest average friction (i.e., friction coefficient) after run-in was observed at 5% SRR and 0.5 m/s as 0.005, while the highest friction (i.e., traction coefficient) was observed at 7% SRR and 0.5 m/s as 0.135. These results were observed as consistent across multiple testing iterations and conclusively show that friction decreased with increasing SRR and speed combinations to a point, and then increased by an order of magnitude past that inflection point.

The friction coefficient was below the superlubricity threshold (e.g., 0.01) at 2% and 5% SRR at both test speeds (i.e., 0.1 and 0.5 m/s), but was higher at 7% SRR. The coatings on the samples were inspected using visible light microscopes for delamination or substrate exposure, and remained intact after all testing conditions. Furthermore, FIGS. 4A-4C illustrate that friction, irrespective of the value, monotonically decreased during the first few minutes of testing, which indicates that there is an active and dynamic process in place. However, it is noted that friction did decrease when SRR increased from 2% to 5%, and again increased when SRR increased to 7%, which indicates that there is an energetically-favorable region from optimum superlative performance. It appears that this may be the result of a balance between SRR-induced lubricity mechanism and shear-rupture that resulted in the local depression in friction. These two observations (i.e., perpetually decreasing friction with time in concurrence with optimal operating conditions) indicates that there may be a scope of perpetually improving lubricity in $MoS_2$-GO over time. Furthermore, the results indicated that superlubricity was achieved at each of the 3 SRRs (i.e., 2%, 5%, and 7%), but that the lowest friction coefficient is observed at a sliding speed of 0.1 m/s and an SRR of 5%. Therefore, the preferred SRR for superlubricity in the arrangement described herein is 5%.

Figure 5:
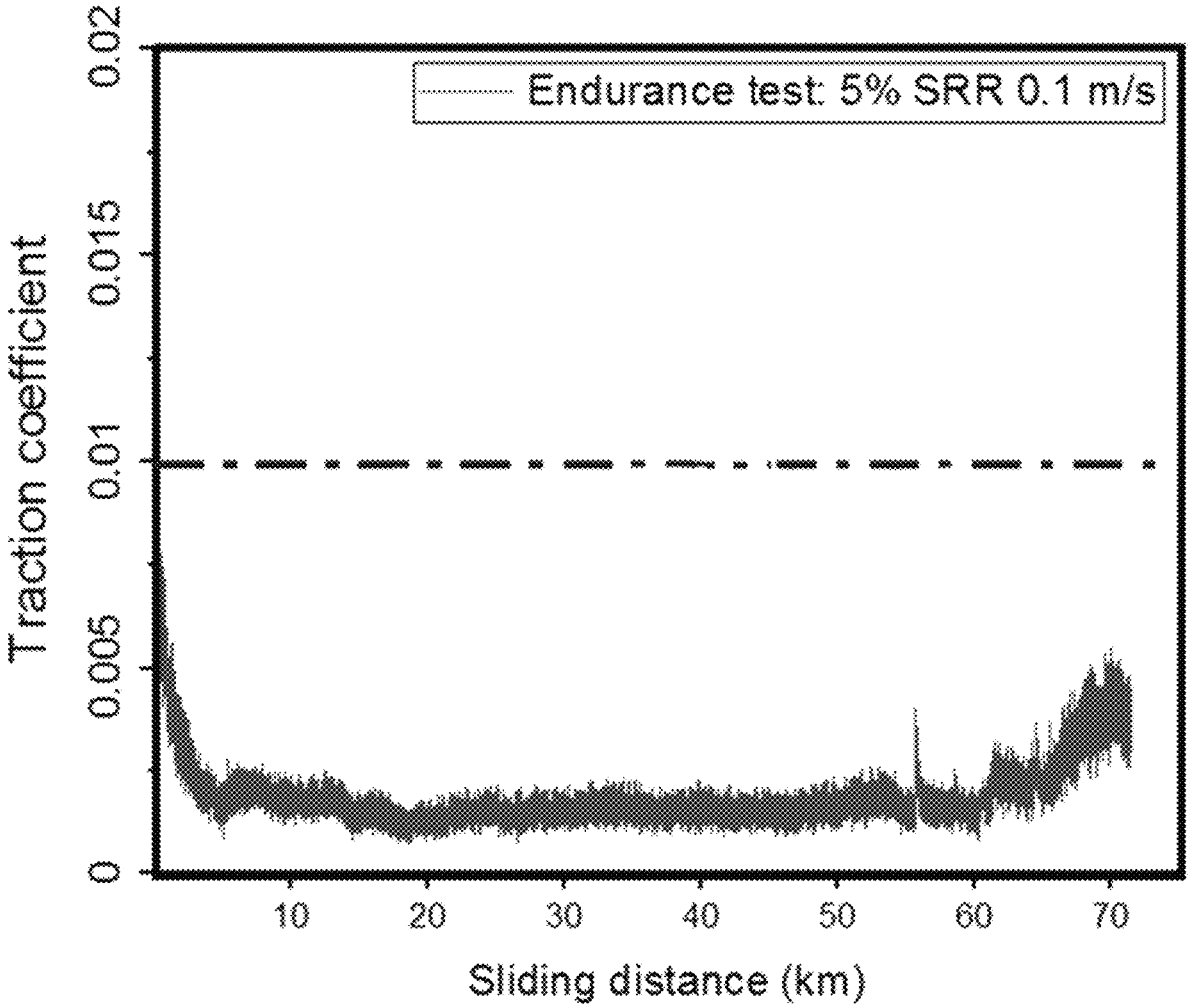
FIG. 5 is a plot of the coefficient of friction as a function of sliding distance for a test duration of at least 70 km.

In order to test the hypothesis of perpetually improving lubricity, a long-term test for over 200 hours (or 70 km of sliding distance) was run at 5% SRR and 0.1 m/s sliding speed. These testing conditions were selected based on resulting in the lowest friction as observed in previous iterations, as shown in FIG. 4B. FIG. 5 shows a plot of friction coefficient values as a function of time during this long-term (or endurance) test. As shown in FIG. 5, the endurance test showed (similarly to the short-term tests of FIGS. 4A-4D) a 'run-in' period during which friction decreased rapidly until reaching a substantially steady-state value. Furthermore, the friction remained well below a superlubricity threshold (e.g., 0.01), which is given as line 320, for the entirety of the test duration. This observation suggests that the run-in period is essentially an amount of time that it takes for a microstructural modification and realignment of the phases for the lubricity to set in.

Figure 6A:
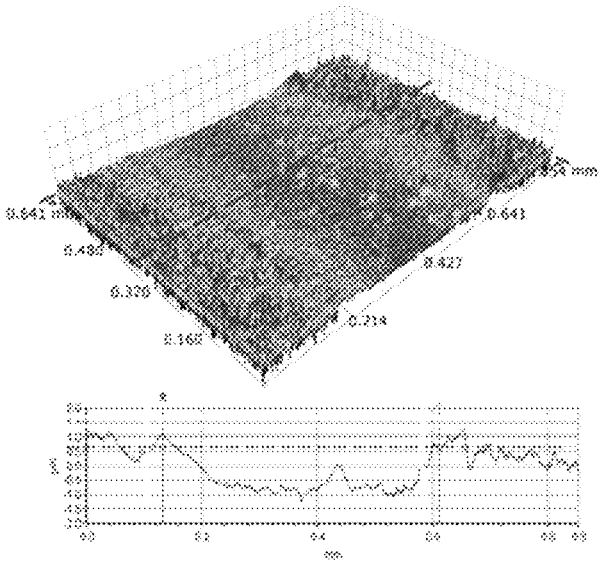
FIG. 6A shows a surface of a disc after the wear test is conducted.
Figure 6B:
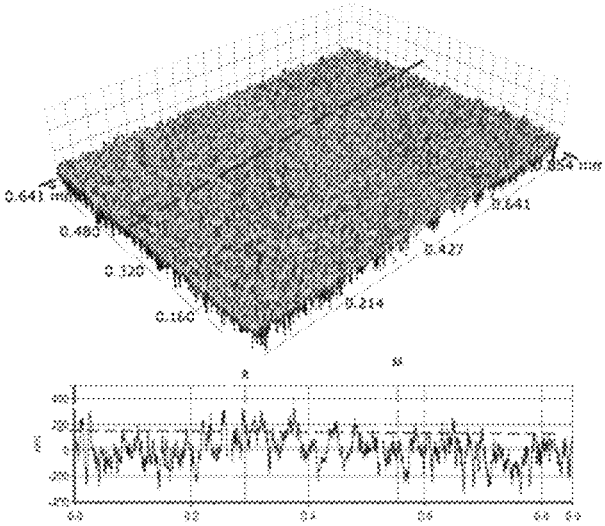
FIG. 6B shows a surface of a steel substrate after 1.4 km of the wear test.

Throughout the endurance test, line scans were performed across the testing surface to analyze the effects of sliding on the lubricant coating. FIG. 6A shows an amount of coating deformation across the surface following the endurance test. As shown in FIG. 6A, a small shallow deformation formed on the surface of the coating. Based on line scans, the deformation is limited to about 400 microns, which is less than the coating thickness. This indicates that, despite the shallow deformation, the coating was present throughout and across the wear track. From there, to further evaluate if any wear had taken place, the coating was removed using a running stream of water, and the resultant surface profiles were again extracted. FIG. 6B shows the surface under the wear track at 5% SRR and 0.5 m/s after 1.4 km of sliding. As shown in FIG. 6B, there was no significant surface change or deformation on the surface. A profiler shows consistent surface roughness as compared to as-received samples, and observations of surface profiles under other testing conditions were similar (not shown).

Figure 6C:
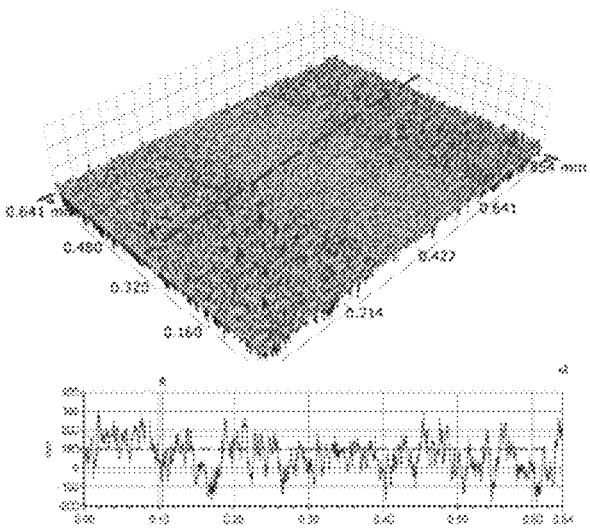
FIG. 6C shows the surface of the steel substrate after 70 km of the wear test.
Figure 7A:
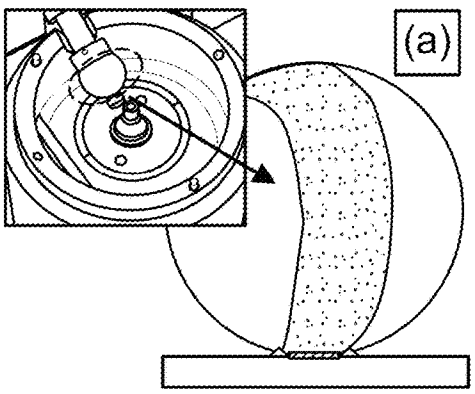
FIG. 7A shows a wear track of the ball from the wear test.

However, after 70 km of sliding, there was identifiable change in surface. FIG. 6C shows the surface under the wear track at 5% SRR and 0.1 m/s for 70 km (or 7 days). As shown in FIG. 6C, there was a faint wear scar visible in the profiler. The surface topography change was within the surface roughness level of the virgin (i.e., uncoated) surface, indicating that extending rubbing results in a "polishing"-like effect as opposed to severe material loss. FIG. 7A shows a schematic of the ball used for the sliding test. As shown in FIG. 7A, the ball showed no significant wear (or "flat"), only a black line (transfer-film) along the wear path on the ball surface. This transfer film was most prominent under 5% SRR, 0.1 m/s sliding speed for 7 days testing conditions, and much less prominent on shorter testing intervals.

Figure 7B:
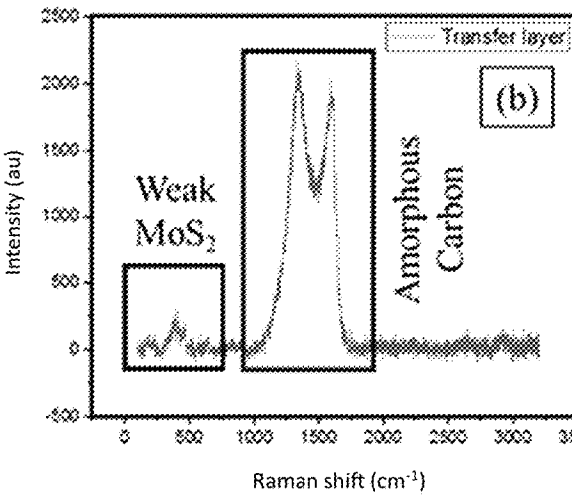
FIG. 7B shows a Raman spectra performed on the transfer layer on the ball.
Figure 7C:
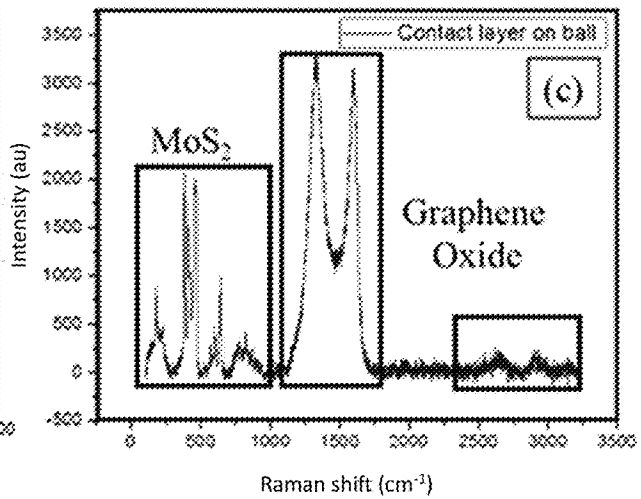
FIG. 7C shows a Raman spectra performed on the contact layer on the ball.

At the end of the testing period, a transfer film (appearing as a thin black line) was observed on the ball. The formation of this transfer film is critical for covering the uncoated steel counter-face and for further protecting the steel surface. FIG. 7B shows the Raman spectra for the transfer layer on the ball of FIG. 7A, and FIG. 7C shows the Raman spectra for the contact layer on the ball of FIG. 7A. As shown in FIGS. 7B-7C, two distinct signatures were observed across the wear track: 1) a fully amorphous carbon region; 2) strongly re-oriented $MoS_2$ and GO along the pile up regions, resembling the signature from the edge of the wear tracks on the discs. The spectra of FIGS. 7B-7C were recorded across the width of the wear track after 70 km of sliding. The area close to the center of the transfer-film showed a strong carbon signature and relatively weak $MoS_2$ signature, while the areas on the edge of the wear track showed strong peaks from both $MoS_2$ and GO. This may be due to the peak shearing-load profile that would have annihilated any structural features of the transfer film. The peak load tapers off towards the edges, which may have preserved a more cohesive structure of the parent material.

Figure 8A:
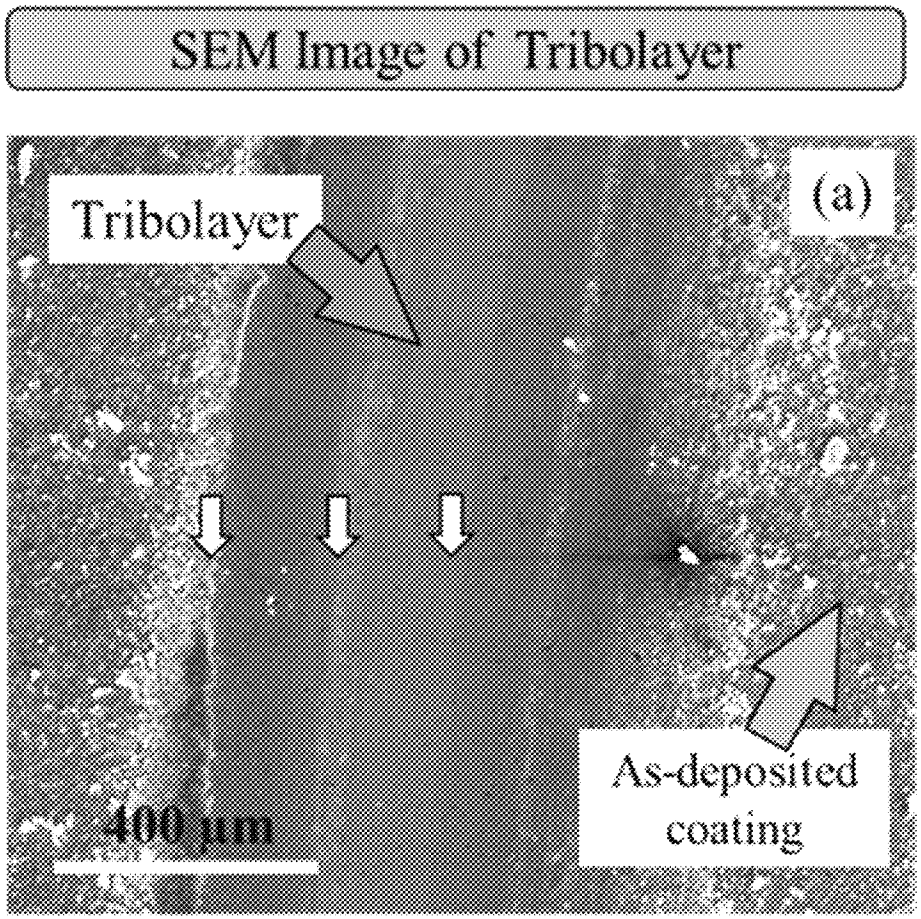
FIG. 8A shows locations on the solid lubricant coating from which Raman signatures were obtained.
Figure 8B:
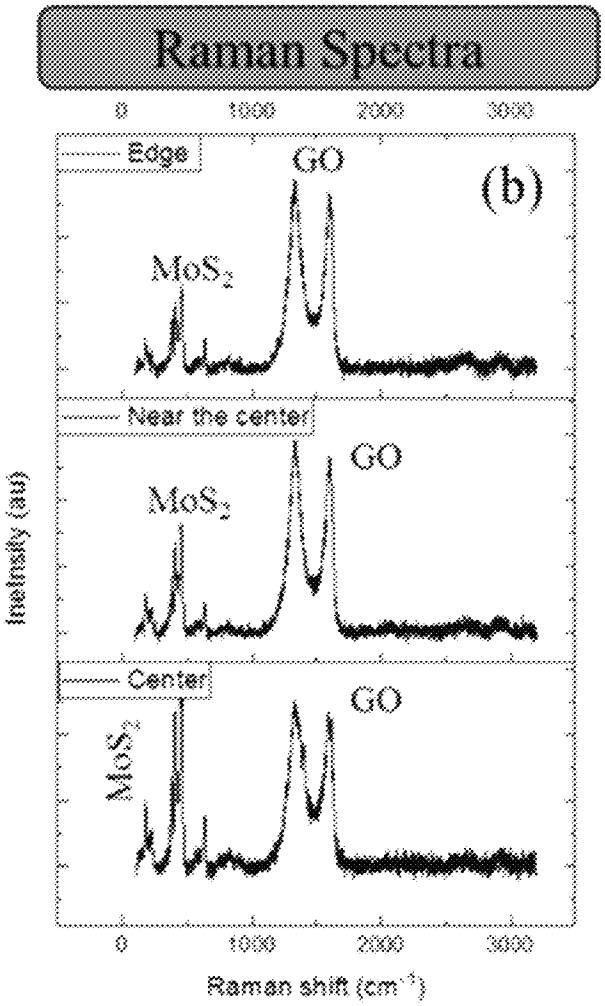
FIG. 8B shows the results of these Raman spectra.

FIG. 8A shows a scanning electron imagine of the wear track on the disc after 70 km of sliding. FIG. 8B shows a Raman spectra across the wear track on the disc. The arrows on FIG. 8A correspond with the Raman spectra plots of FIG. 8B, and show acquisitions near the edge, midway, and center of the wear track. As shown in FIG. 8B, the intensity of GO peaks were significantly stronger as compared to the $MoS_2$ peaks at the edge of the wear track, bearing close resemblance to the as-deposited material. The relative intensities of the GO and $MoS_2$ components of the spectra gradually transition from the edge to the center of the wear track, such that the $MoS_2$ peaks gain prominence in the same peak positions while GO peaks weakened in intensity. This trend was symmetric on each side of the wear track, and is in contrast to the ball, which had $MoS_2$ peak intensity lower in the center with an amorphous carbon signature. Significantly, there was a complete absence of peaks at 285, 666, 820, and 995 cm', which correspond to Mo-Oxides.

Figures 9A, 9B, 9C, 9D:
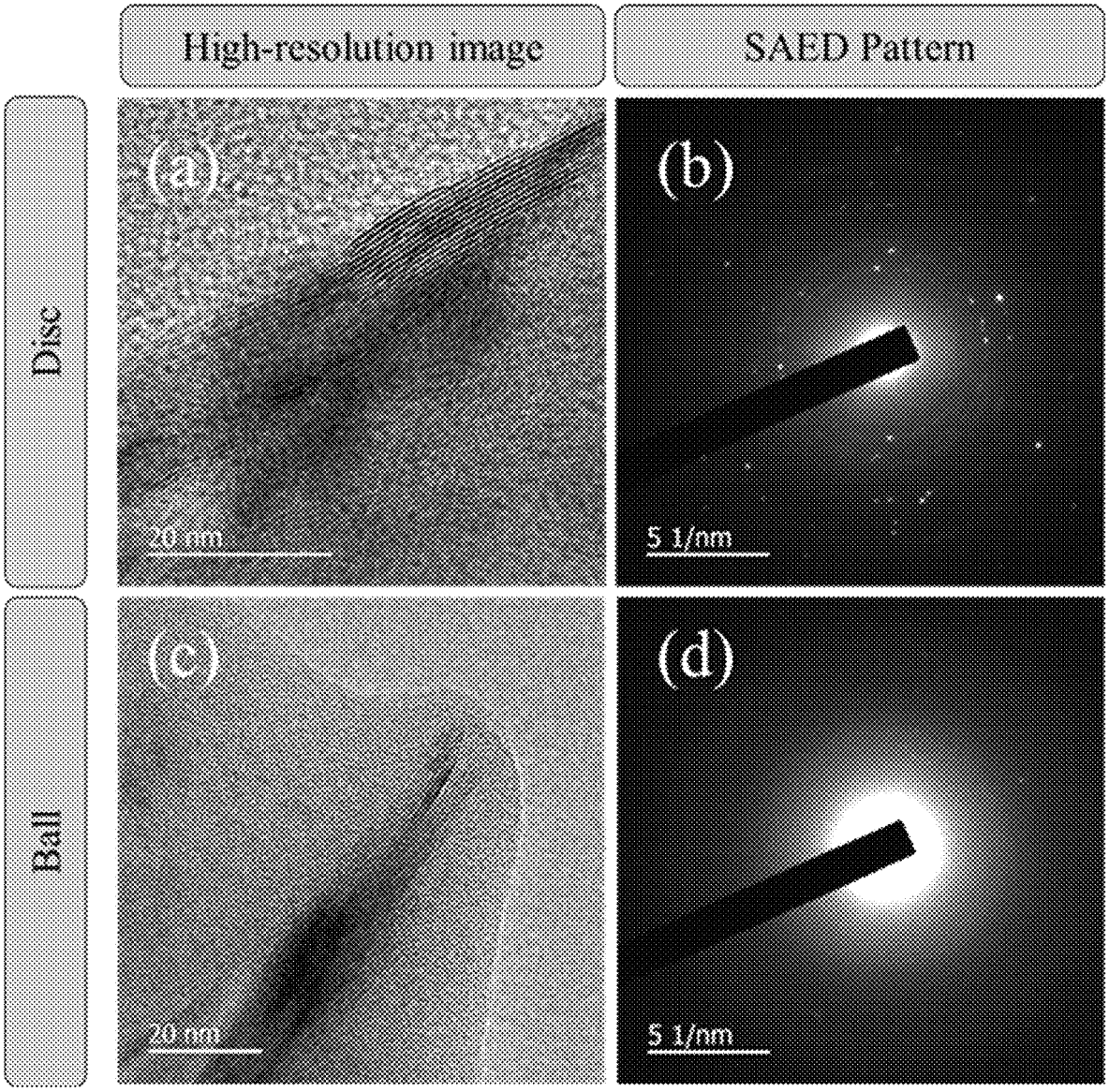
FIG. 9A is a bright field image showing $MoS_2$ and GO phases on the disc.
FIG. 9B is a diffraction pattern showing $MoS_2$ and GO spots on the disc.
FIG. 9C is a bright field image showing large amorphous carbon flakes and intact $MoS_2$ flakes on the ball.
FIG. 9D is a diffraction pattern showing amorphous ring of carbon in transfer-film on the ball. Each of FIGS. 9A-9D were captured from samples taken after a 1.4 km test.

FIGS. 9A-9B show results from TEM analysis performed for a disc from the 1.4 km sliding distance test. FIGS. 9C-9D show results from TEM analysis performed for a ball from the 1.4 km sliding distance test. FIGS. 9A and 9C are high resolution bright-field images, while FIGS. 9B and 9D are diffraction patterns. The microstructure of the tribolayer of the disc retained the as-deposited coating's features—large flakes of GO and darker patches of $MoS_2$ sandwiched betwixt the GO phases. As shown in FIG. 9B, the diffraction pattern of the tribolayer has both $MoS_2$ and GO diffraction spots, in concurrence with the aforementioned Raman spectra from FIGS. 8A-8B. The SAED pattern of FIG. 9B also show hexagonal spots that correspond to interpenetrating the basal planes of $MoS_2$ and GO. As shown in FIG. 9C, the transfer layer on the ball showed amorphous carbon, which is consistent with the selected area diffraction pattern of FIG. 9D. Furthermore, the TEM results in FIGS. 9A-9D concur with the Raman spectra results from FIG. 8B. Furthermore, as shown, the tribolayer formation on the disc was very different as compared to the tribolayer formation on the ball. The disc underwent changes in the structure of both $MoS_2$ and GO, but the structure remained more intact, as shown in FIG. 9A. The GO retained its lattice structure, and the carbon itself sandwiched $MoS_2$ flakes.

FIGS. 10A-10D show TEM imagines from the tribolayer of the 70 km sample from the disc. As shown, there are three distinct features: 1) amorphous carbon with no distinct interplanar spacing towards the surface; 2) highly oriented $MoS_2$ flakes with d-spacing consistent with that of the pristine material; and 3) closely-placed GO lakes with structural integrity and morphology. These observations were further supported by the corresponding Raman spectra. Such simultaneous occurrence of amorphous carbon, graphene oxide, and $MoS_2$ indicate that there may be a morphological transition of GO into amorphous carbon under the influence of shearing, while $MoS_2$ largely retained its structural integrity.

Figure 10A:
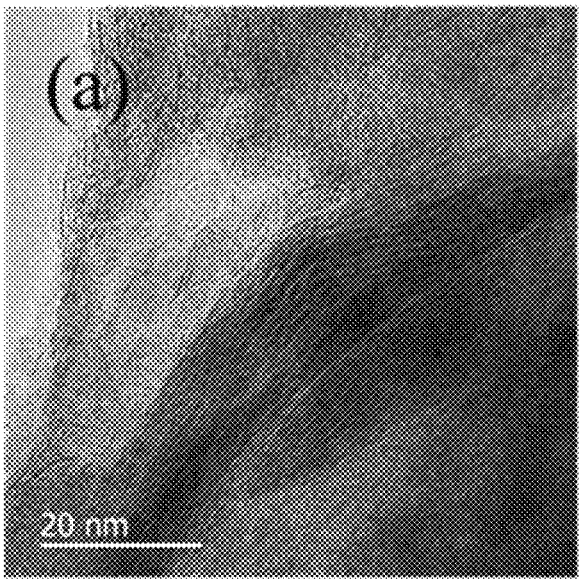
FIGS. 10A-10D are TEM images showing the morphological changes in a tribolayer of the ball with time, and were taken after a 70 km test at 5% slide-to-roll ratio.
Figure 10B:
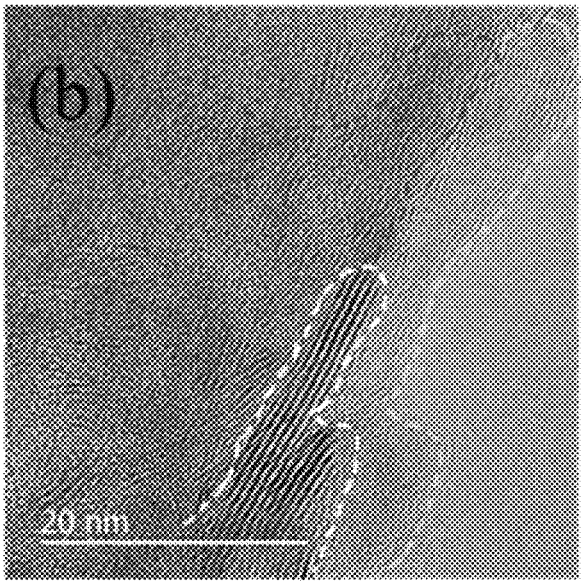
Figure 10C:
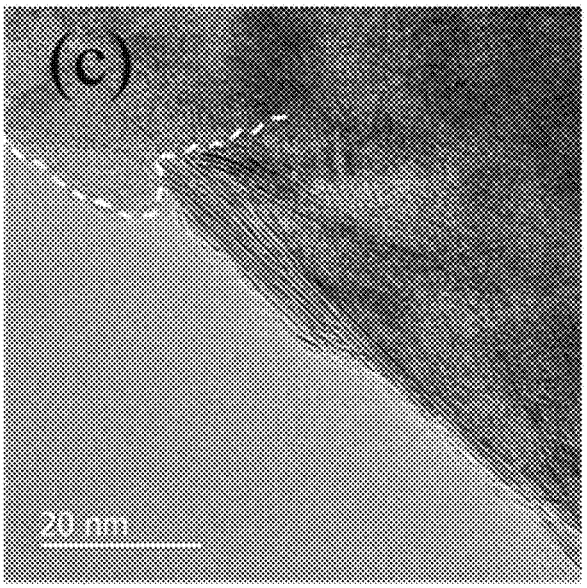
Figure 10D:
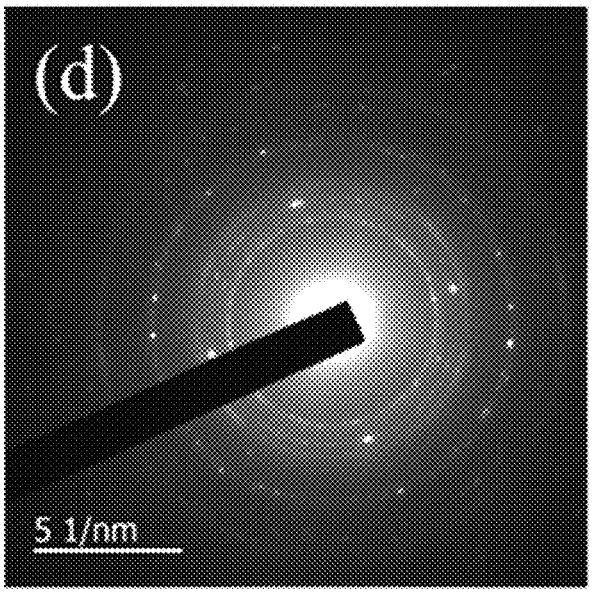

Although $MoS_2$ and GO phases are present in the parent solution in equal proportions, the microstructure seen in FIGS. 10A-C indicate that carbon/graphene preferentially encapsulates $MoS_2$. Theoretically, molecular dynamics (MD)-based simulations indicate that this may be energetically more favorable since yield strain in the $MoS_2$ is significantly reduced when outer graphene layers buckle, which facilitates relative ease in shearing of $MoS_2$. This buckling is shown to result from the spontaneous strain energy arising at the $MoS_2$/graphene interface, which, in turn, is attributable to a mismatch between the lattice constraints.

Figure 11A:
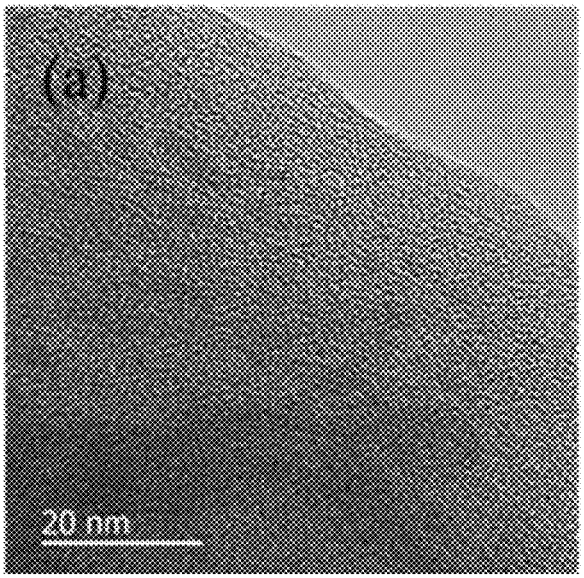
FIGS. 11A-11C are TEM images showing the morphology and structure of coating in the wear track and transfer film of the ball after 70 km sliding at 5% slide-to-roll ratio.
Figure 11B:
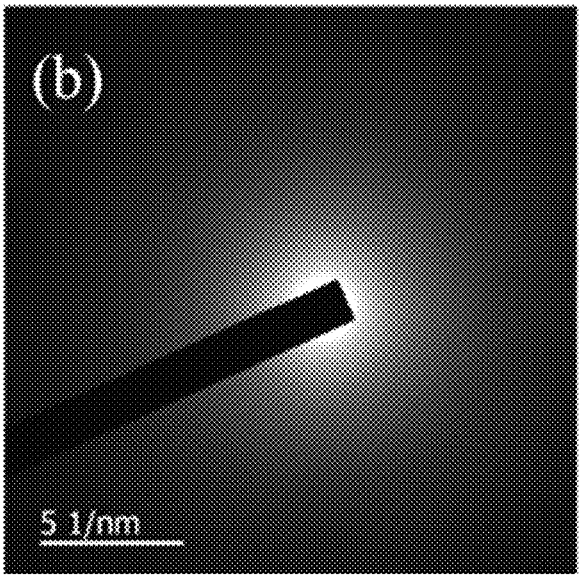
Figure 11C:
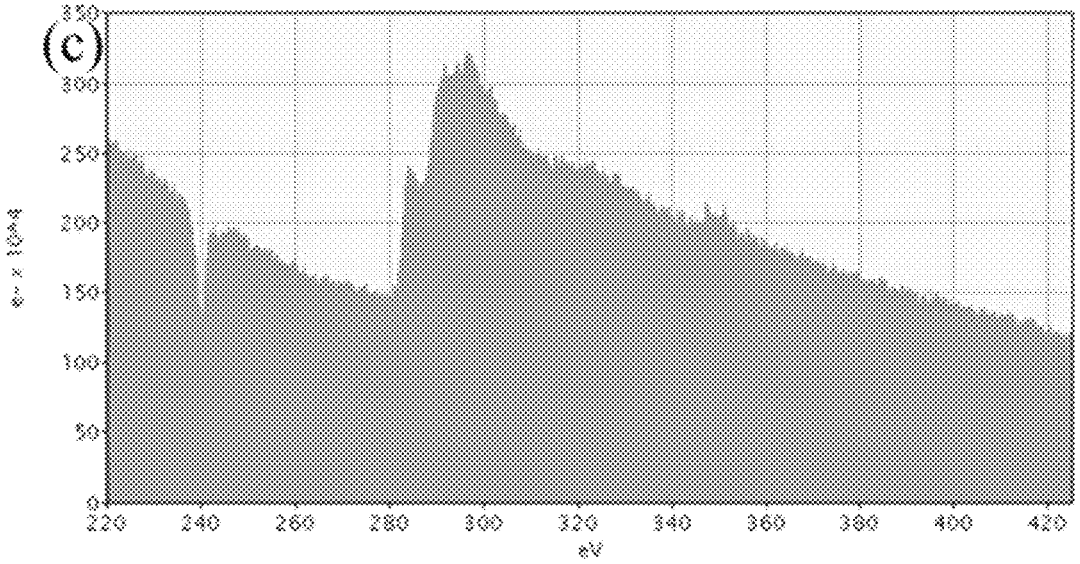

The observation of amorphous carbon on the out surface, followed by $MoS_2$ and GO bi-layers was consistent across several sample extracts from the discs. The transfer layer on the ball (i.e., the counterface) was examined to identify the morphological changes that were produced following the 70 km test. FIG. 11A shows the TEM observations in the transfer-films after 70 km of sliding. As shown in FIG. 11A, the TEM bright-field image details the morphology of the tribolayer extracted from the ball, and FIG. 11B shows an electron diffraction image at the same location. As shown in FIG. 11B, the diffraction patterns shows a diffused halo, which indicates that an amorphous carbon phase was present. This full amorphous carbon phase is akin to free-standing amorphous carbon as reported elsewhere. As shown in FIG. 11C, the electron energy loss spectroscopy (EELS) supports this conclusion that amorphous carbon is present. While the GO and $MoS_2$ on the disk retain most of their initial structure and morphology, the finer and fragmented phases on the ball were due to the higher rotating speed experienced by the ball due to the SRR.

Another factor that likely contributed to the super lubricity, in addition to the interlayer structural configurations, is the sliding environment of the test. Simulations using density functional theory by others show that GO layers sliding in dry nitrogen atmosphere tend to electrostatically repel each other, forming flakes and nanoparticles, contributing to smaller contact area and, therefore, lower friction. Prolonged sliding may have resulted in complex phenomena involving a) compression and densification of loosely sprayed powder; b) re-orientation of nano-flakes; c) shearing and spreading out; and d) transformation of GO to amorphous carbon. Amidst these complex phenomena, the coating thickness did decrease due to mechanical compression, but the lubricious behavior improved throughout. This observation experimentally validates the observation that lubricity performance was not observed to depend on the thickness of $MoS_2$. As such, the combined effect of the high lubricity of GO at high contact pressures in dry nitrogen atmospheres and that of $MoS_2$ are critical in the observation of superlubricity of the lubricant.

FIGS. 12A-12C show the mechanical behavior of the coated material, tribolayer, and transfer film, as assessed by nanoindentation. FIG. 12A shows the SEM image of the tribolayer, and indicates the locations of the assessing nanoindentations. Nanoindentation performed on the as-deposited coated areas did not produce adverse results, which indicates that the highly porous nature of the surface did not offer any resistance to indentation. As shown in FIGS. 12B and 12C, indentations performed on the tribolayer after 1.4 km sliding showed a hardness of 1.4±0.38 GPa and a modulus of 73.3±16.9 GPa, while the hardness after 70 km sliding was 2.26±0.67 GPa hardness and the modulus was 93.8±24.3 GPa. Hardness is calculated according to the following formula:

$$H = \frac{P_{max}}{A_c}$$

where $P_{max}$, was maximum load, and $A_c$ was contact area. Contact area was in turn calculated from the contact depth $h_c$ according to the following formula:

$$h_c = h_{max} - \varepsilon \frac{P_{max}}{S}$$

Finally, modulus was calculated according to the following formula:

$$E_r = \frac{\sqrt{\pi} S}{2\beta\sqrt{A_c}}$$

This increase in hardness and modulus over time may be explained as a consequence of compaction and densification of the coating deposited on the surface with prolonged mechanical working. The ratio of hardness to modulus (expressed as H/E) is greater for the tribolayer after 70 km of sliding, which indicates that the overall deformation of the tribolayer was higher in this case. Physico-mechanical compaction of the two constituent phases, and consequent densification facilitates better shearing of the layered 2D lubricants because closely-packed planes shear more than loosely packed planes. This, in conjunction with the previously-discussed chemical and microstructural features, would also explain the perpetual increase in hardness, as well as the decrease in friction, during the early stages of the test.

Figure 13:
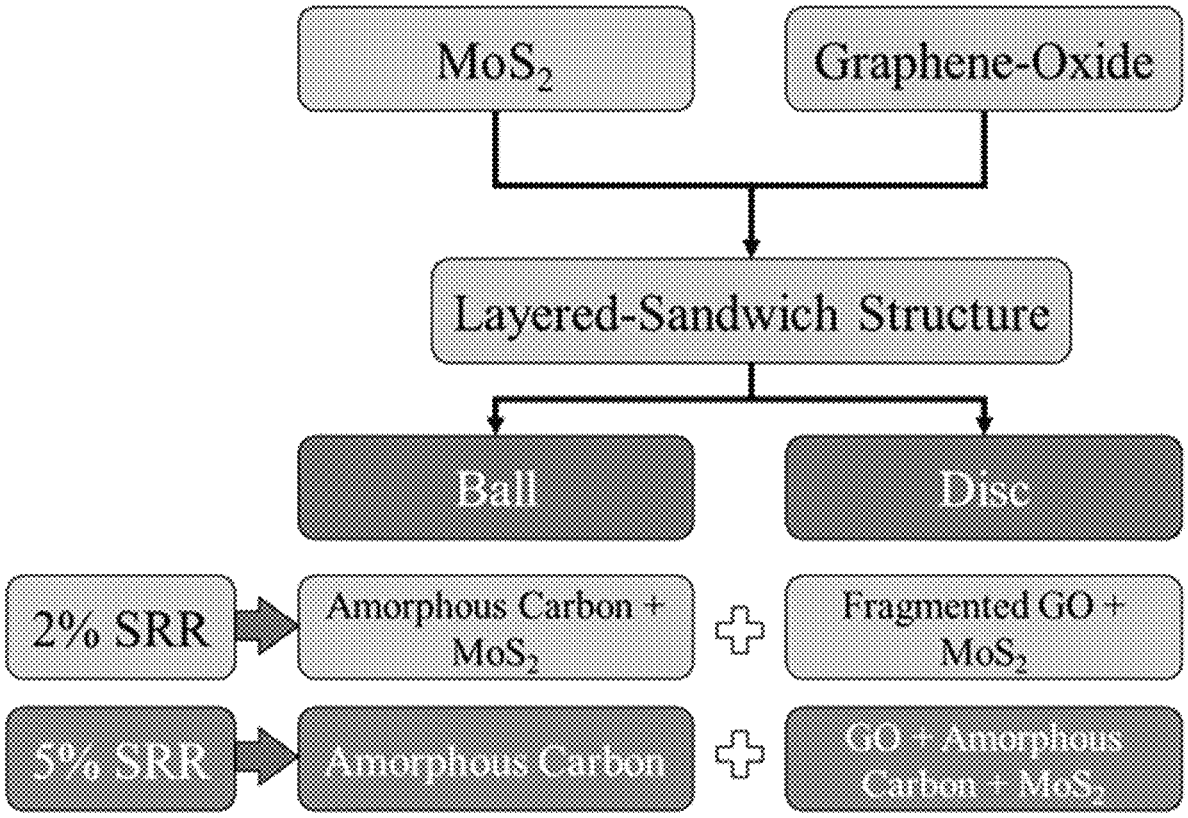
FIG. 13 is a schematic showing enhanced shearing of constituent 2D-layered phases driven by compaction and densification of the materials in the tribolayer.
Figures 14A, 14B, 14C, 14D:
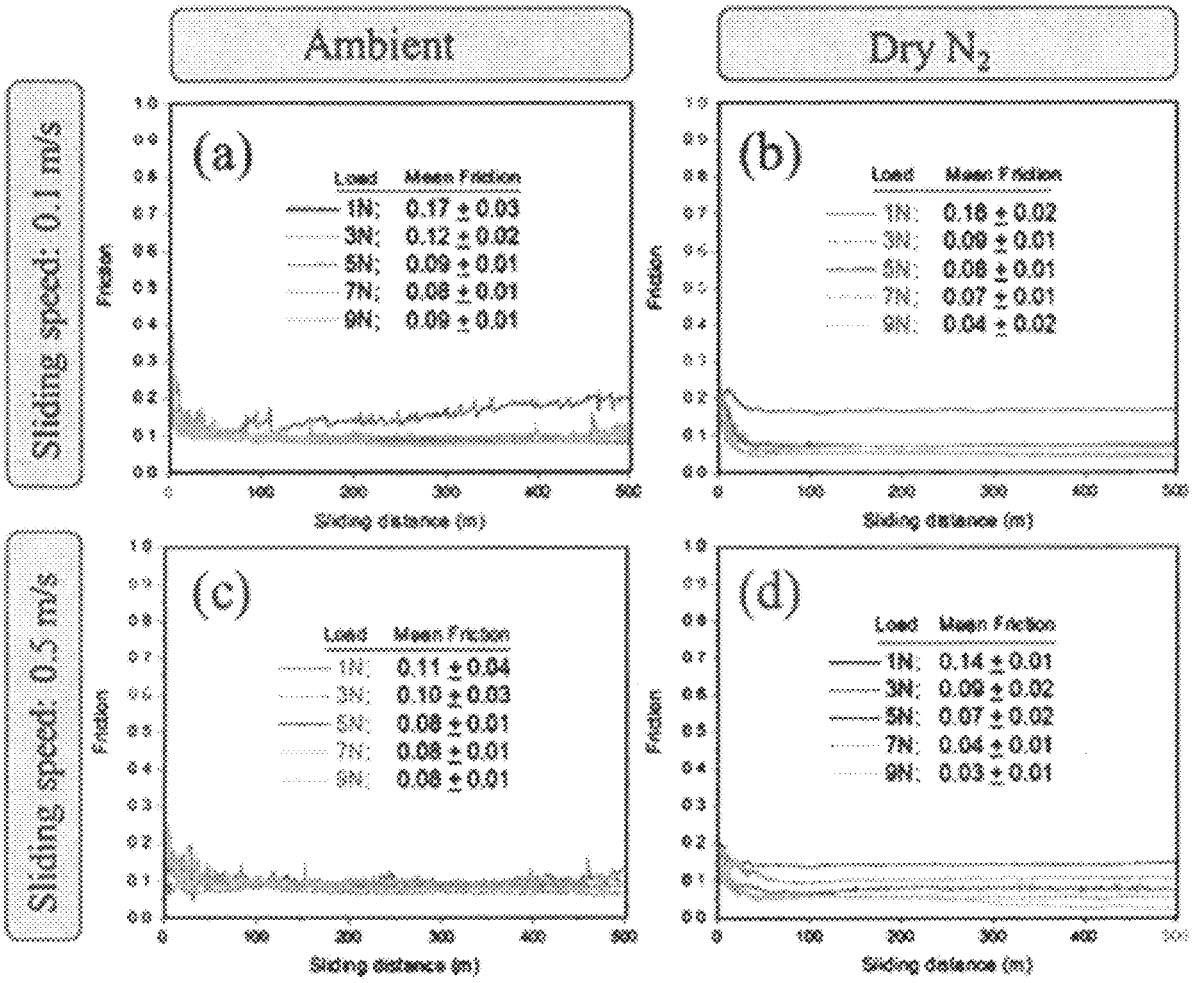
FIGS. 14A-14D are plots of friction observed when sliding bare 440C steel ball against 440C steel disc coated with $MoS_2$-GO solid lubricant for different atmospheres, loads, and sliding speeds.

FIG. 13 is a schematic that's shows a proposed mechanism and evolution of the solid lubricant. As shown in FIG. 13, the $MoS_2$ and GO form a layered sandwich structure when mixed and coated onto the substrate. Then, as contact and sliding-rolling occurs, a superlubricious layer of fragmented GO and $MoS_2$ flakes is formed, with gradual disintegration of GO phase but retention of $MoS_2$ on the disc. In contrast, the transfer-film on the ball is largely composed of highly amorphous carbon as confirmed by Raman spectroscopy, bright field imaging, and diffraction spectra in TEM. These chemical changes, accompanied by the physico-mechanical steps of densification and compaction, promote higher shear in $MoS_2$.

Figure 15:
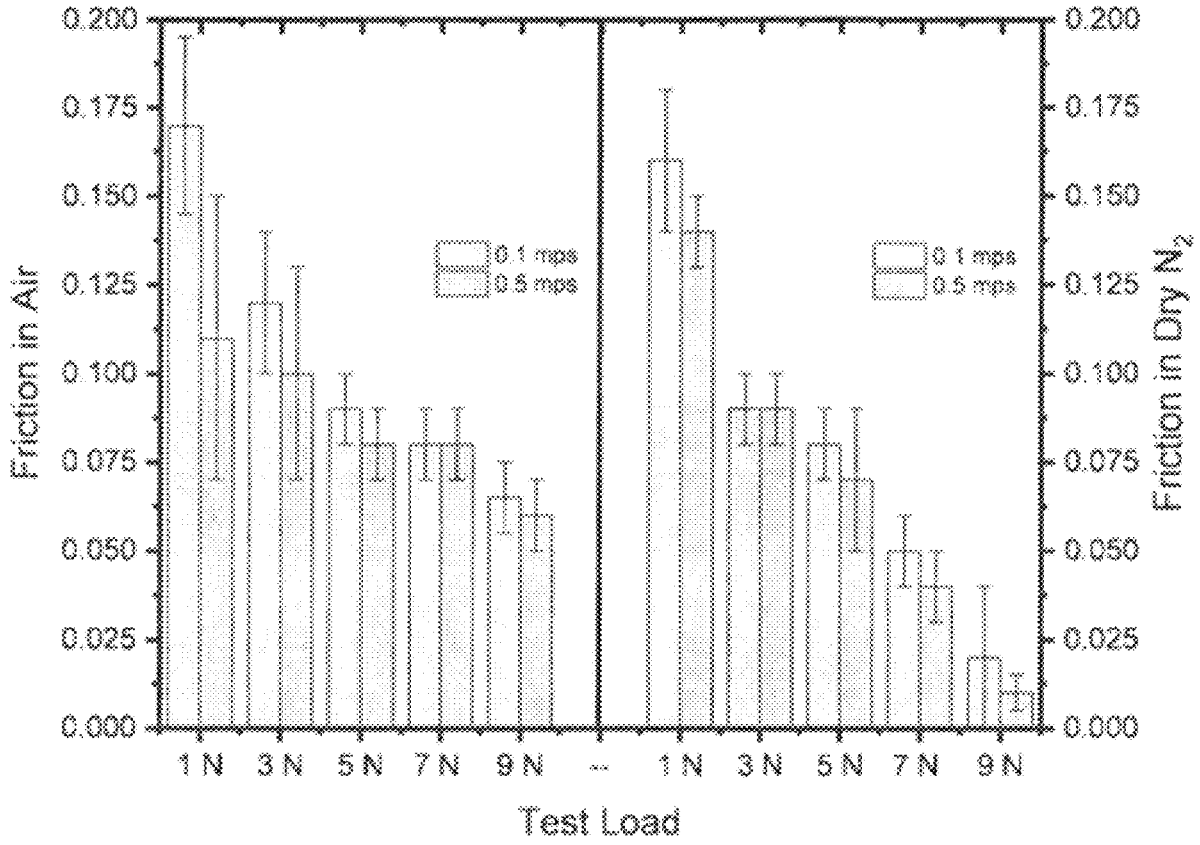
FIG. 15 is a summary of friction data observed in dry nitrogen and ambient conditions when tested at 1-9 N normal load and 0.1 and 0.5 m/s test speeds in unidirectional sliding.
Figure 16:
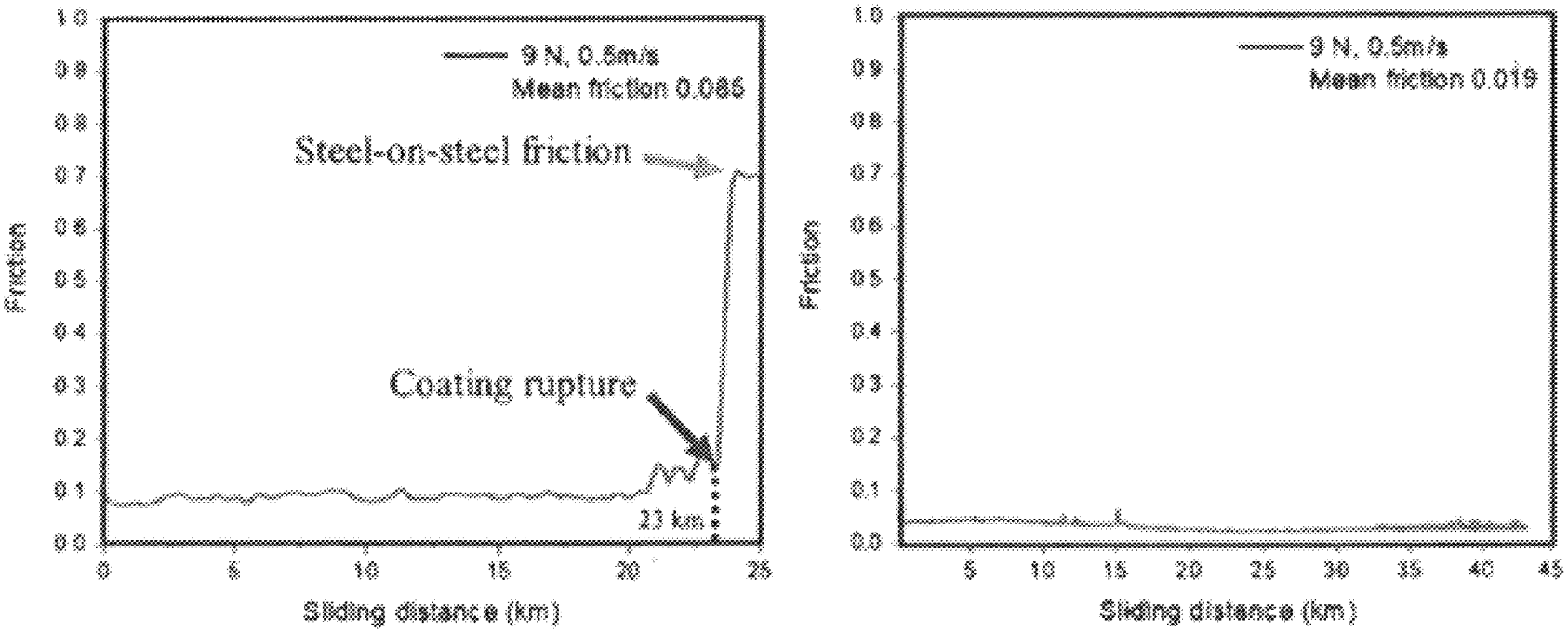
FIG. 16 is a frictogram showing the friction values and coating endurance when tested in ambient air and in dry nitrogen at 9 N normal load and 0.5 m/s sliding speed.

To augment what was learned from the MTM tests, unidirectional sliding tests were performed using steel discs prepared similarly to the steel substrate for the MTM tests. FIGS. 14A-14D show plots of observed friction at different atmospheres, loads, and sliding speeds as a function of sliding distance. For each of FIGS. 14A-14D, the friction is observed when sliding a bare 440C steel ball against 440C steel disc coated with $MoS_2$-GO solid lubricant. FIG. 15 further shows the results of this friction data for different atmospheres (e.g., ambient air and dry nitrogen). As shown in FIG. 15, the friction trend was observed to have a monotonous decrease in friction with increasing normal load, which conforms to Amonton's Law. The lowest friction in ambient conditions was observed as 0.045 at 9 N normal load and 0.5 m/s sliding, but was at 0.015 (miniscule above the superlubricity threshold) for the same test in dry nitrogen conditions. Under ambient conditions, the test was able to run for about 12 hours before the coating ruptured, as shown in FIG. 16. In contrast, the dry nitrogen conditions allowed the test for run for at least 24 hours without deterioration of the coating.

Figure 17:
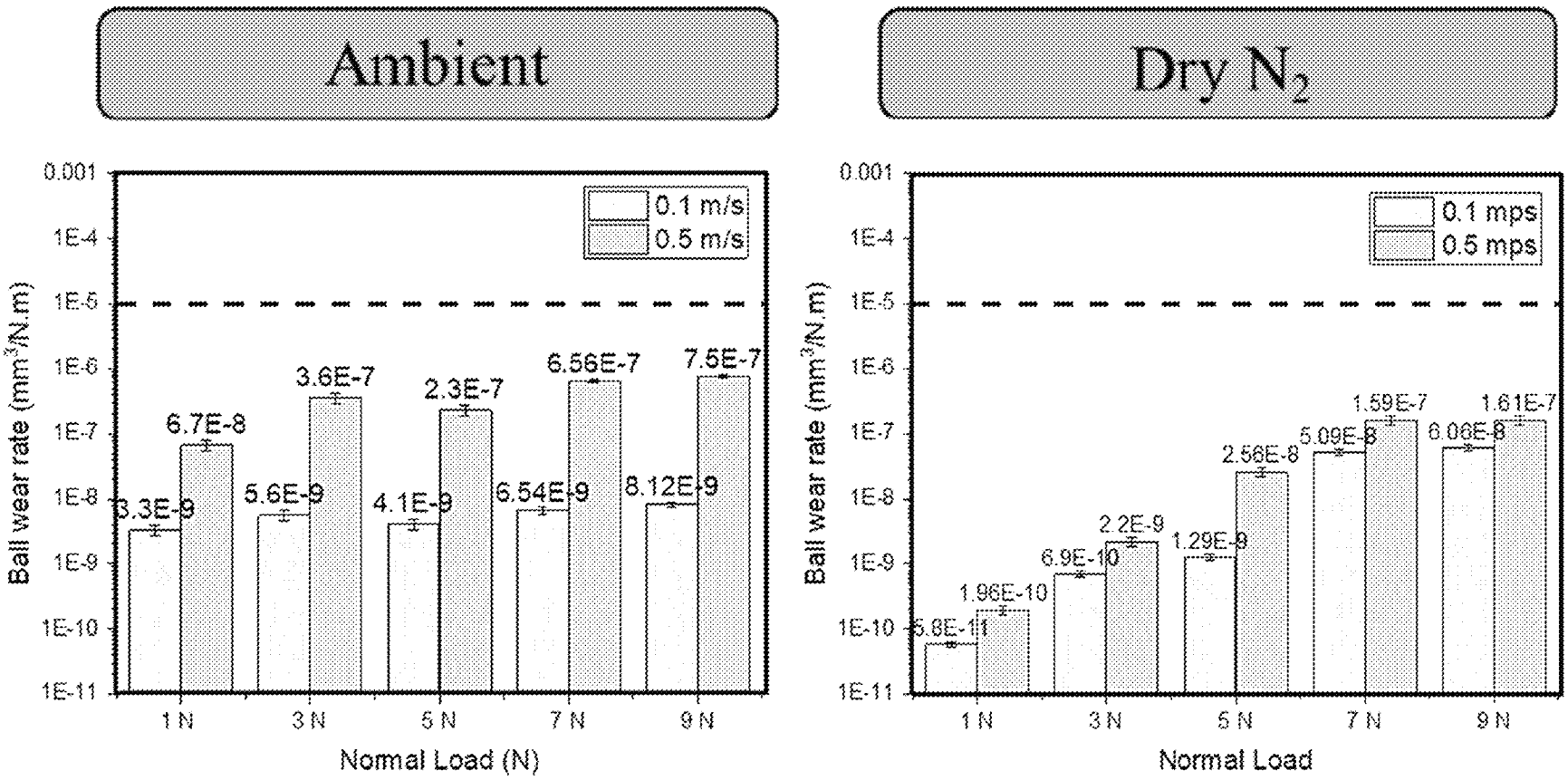
FIG. 17 are plots showing wear rate on the countersurface when tested 1-9 N and sliding at 0.1 m/s-0.5 m/s for ambient and dry nitrogen testing conditions.
Figures 18A, 18B, 18C, 18D, 18E, 18F:
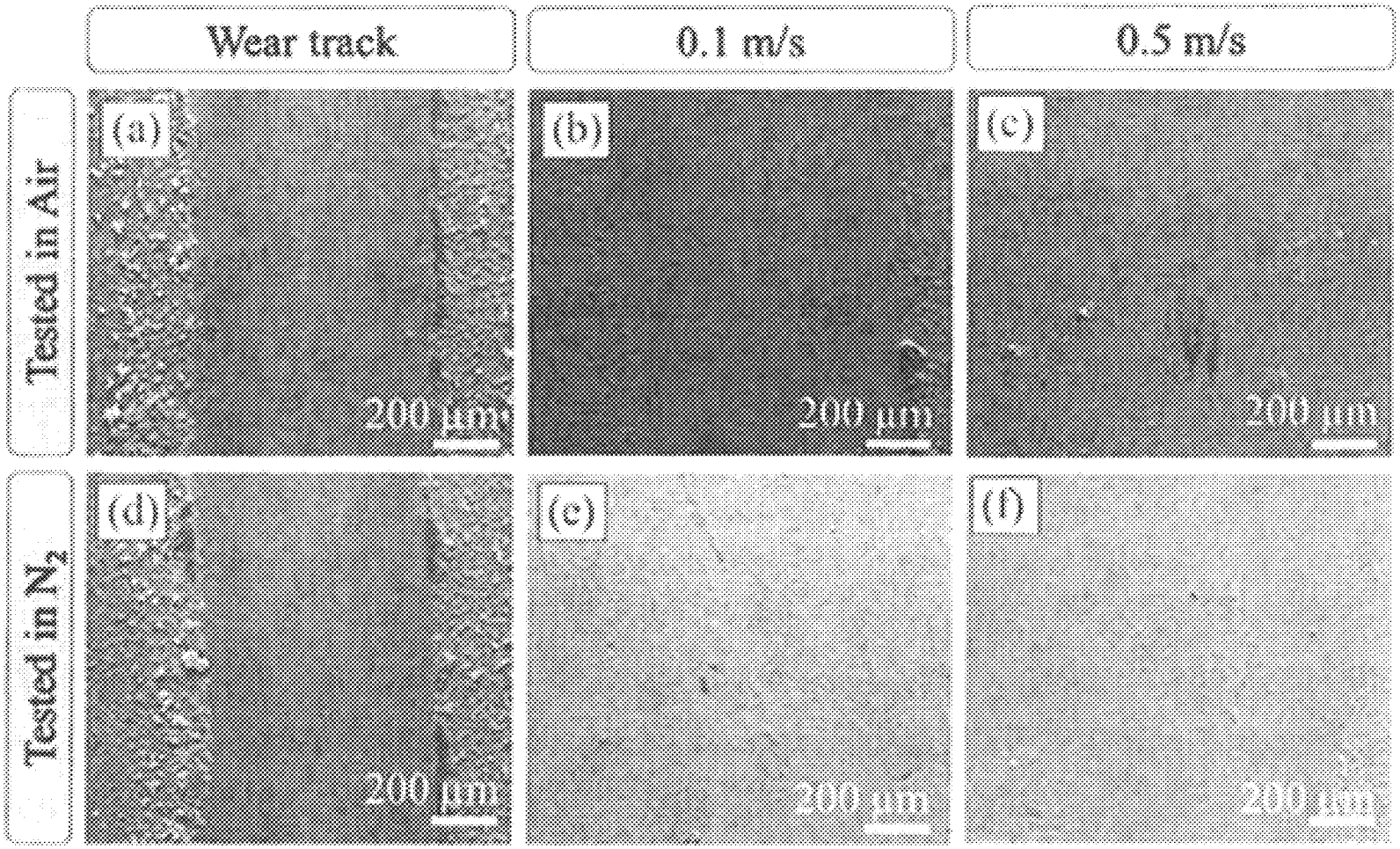
FIGS. 18A-18F show wear on the coated substrates in ambient air and dry nitrogen before and after being clean and at various sliding speeds.
Figures 19A, 19B:
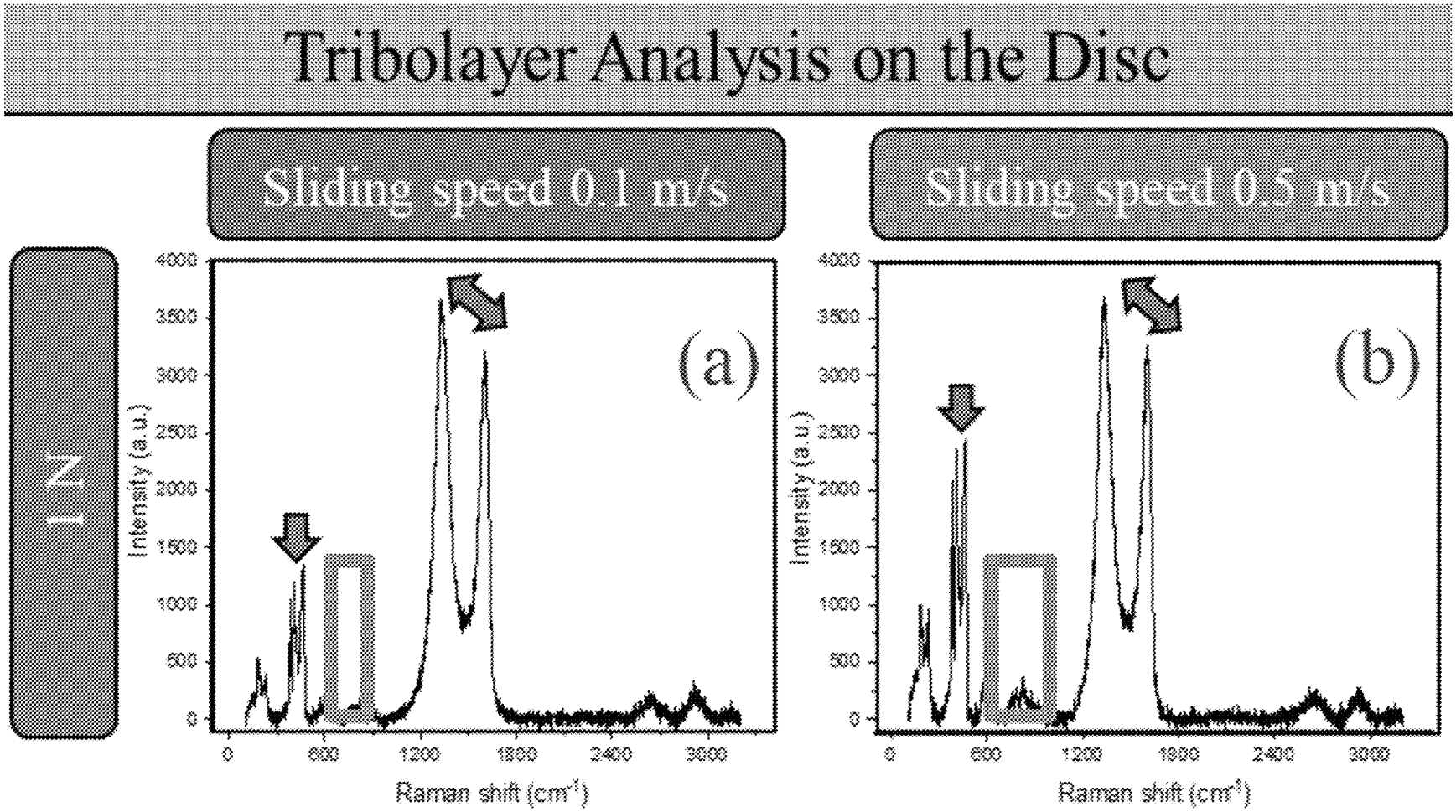
FIGS. 19A-19F show Raman spectra for the tribolayer on the disc at various loads and sliding speeds.
Figures 19C, 19D:
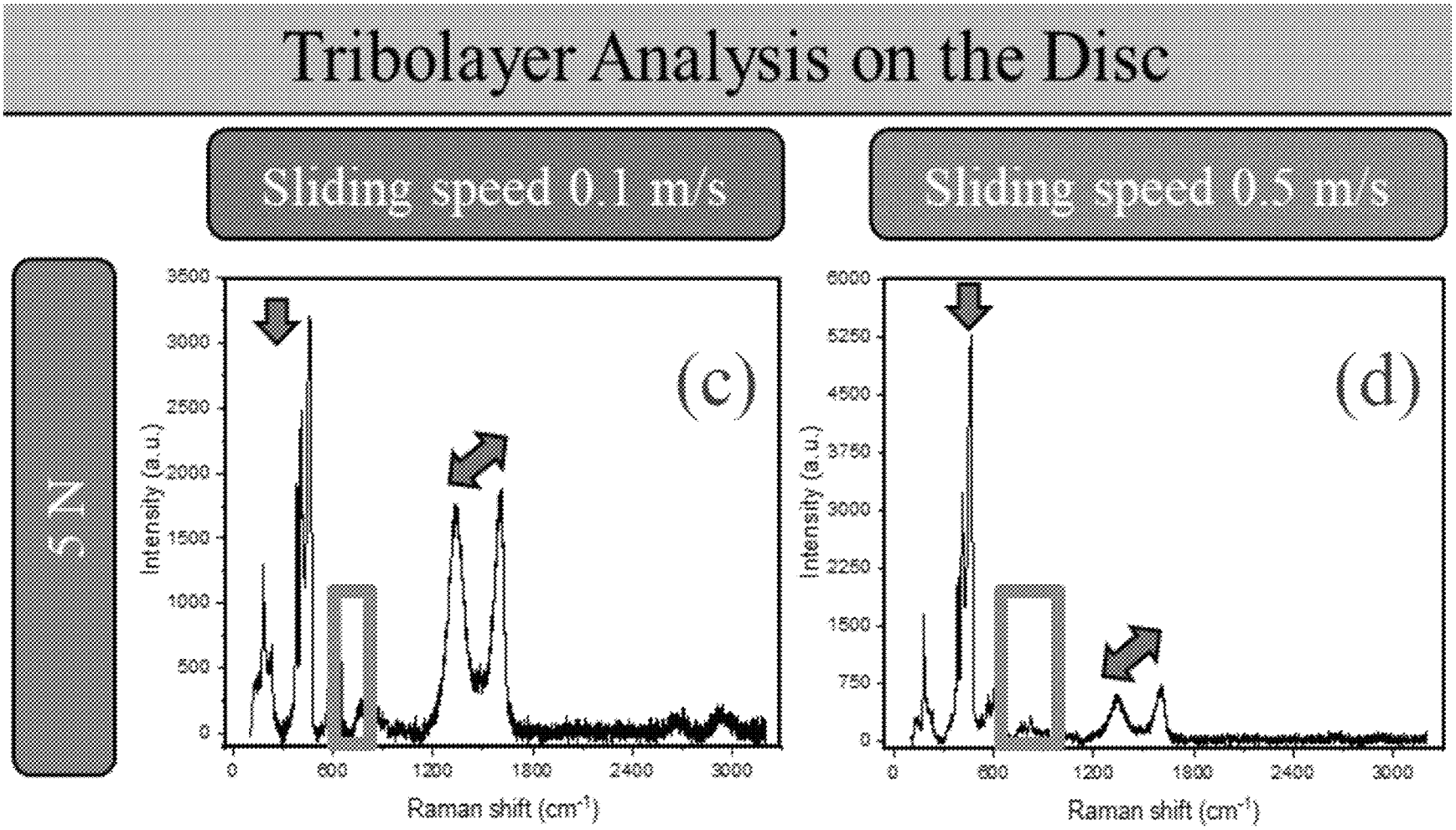
Figures 19E, 19F:
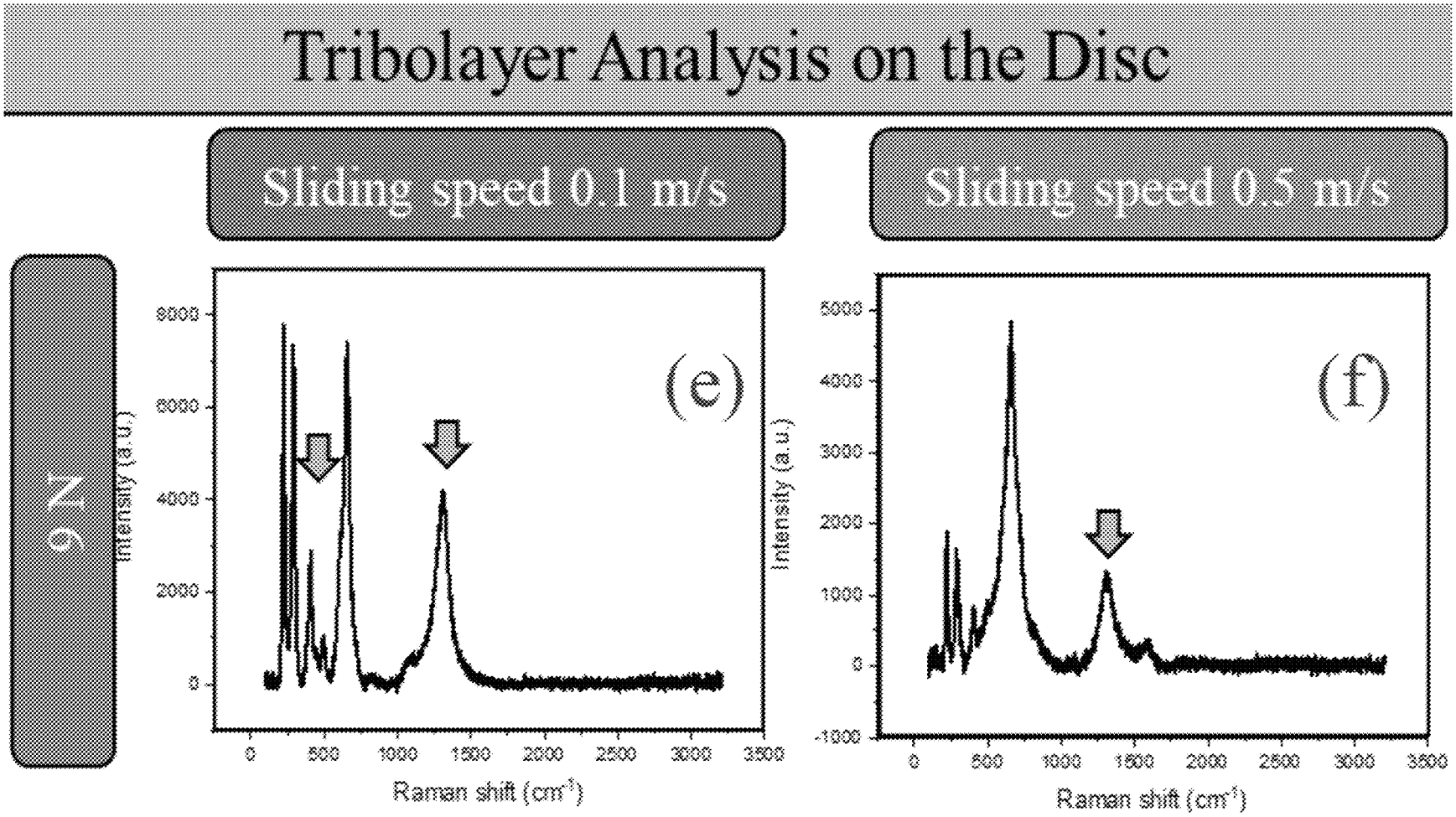

In addition, the unidirectional sliding tests show that the wear on the ball (i.e., the counterface) was four orders of magnitude lower, as compared to unlubricated contact, for lubricated contact in ambient conditions and seven orders of magnitude lower for lubricated contact in dry nitrogen. FIG. 17 plots the results of the wear rate as a function of load for ambient conditions and dry nitrogen conditions. As shown in the FIG. 17, the dotted line represents the wear rate at 1 N for unlubricated contact. The test cannot be run at higher loads (e.g., 3 N and above) due to "jamming" of parts during sliding because of the high friction. In contrast, the wear on the ball was two orders of magnitude lower at 9 N when compared to the unlubricated test at just 1 N. The steel substrate was also evaluated for wear volume loss following sliding tests in both environments. FIGS. 18A-18F show the results from this wear volume loss evaluation. As shown in FIGS. 18B-18C and 18E-18F, there was no observable wear, indicating a high degree of wear resistance imparted, in addition to exceptional lubricity. These results agree with the results from the MTM tests show in FIGS. 6A-6B.

In order to further investigate the wear resistance and lubricity, Raman spectroscopy of the tribolayers was utilized. FIGS. 19A-19F show the resulting spectra across various loads and sliding speeds. As shown in FIGS. 19A-19F, the spectra show increased $MoS_2$ peak intensity with increasing normal load and sliding velocity. This, in conjunction with absence of MoOx peaks, indicates a strong resistance to intercalation with moisture and oxygen. Raman spectroscopy analysis of the tribolayers suggested in operando re-orientation of $MoS_2$ crystals promoted by increasing energy in the tribosystem. From a structural point of view, it has been discussed previously herein that highly oriented $MoS_2$ flakes are inherently more resistant to oxidation (see FIGS. 7A-7C). This observation, therefore, is in line with previous reports that lowering of friction over time (i.e., 'run-in') is correlated with crystallographic re-orientation of the $MoS_2$. In the current testing work, the effect of load and sliding speed were also observed to accelerate the transition into a steady-state low friction regime.

Figure 20:
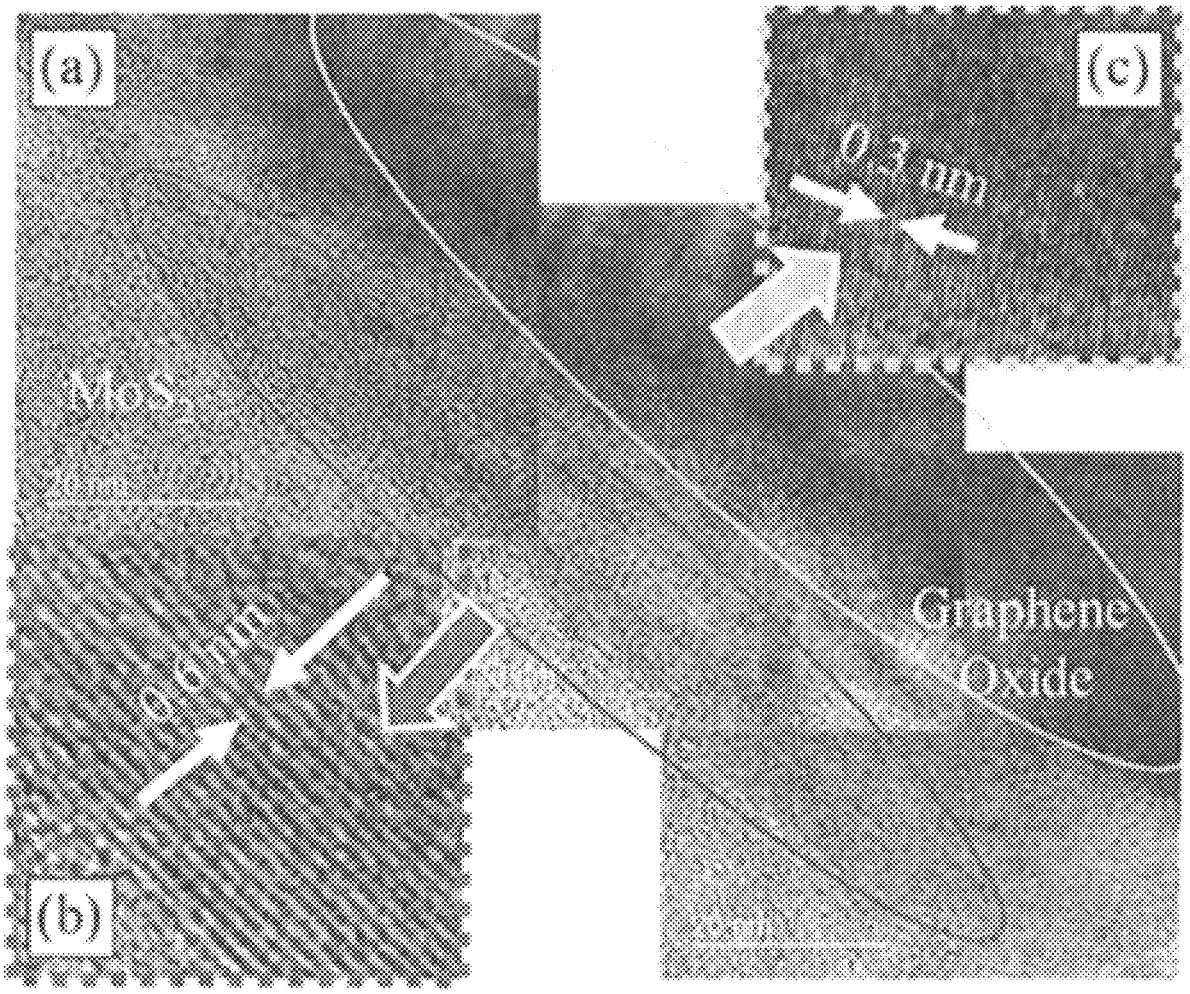
FIG. 20 is a TEM image of the tribolayer showing amorphous carbon, $MoS_2$, and GO in a sandwich structure.

To confirm the above, TEM samples were extracted from the tribolayers of the three load conditions. The samples from lower test loads and speeds did not show any significant layer level bonding and phase re-formation, and largely maintained their individual characteristics. As shown in FIG. 20, this drastically changes in the formation of a robust tribolayer (at high loads and high sliding speeds in either ambient or dry nitrogen environments), where multiple layers of $MoS_2$ have been observed to be stacked and oriented so as to form a long packet. Intact GO was observed on one side and amorphous carbon on the other side of the packet, indicating that GO indeed disintegrates to some extent, as well as forms layer-level encapsulation. These TEM observations align with the operando tribochemical evolution, as seen in the Raman spectra of FIGS. 19A-F.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." Any ranges cited herein are inclusive.

The terms "substantially" and "about" used throughout this Specification are used to describe and account for small fluctuations. For example, they may refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed:

1. A method of forming a low friction wear surface comprising:

disposing over a substrate a solution comprising a composite of molybdenum disulfide ($MoS_2$) and graphene oxide (GO) 100-1000 nm thick to form a layered-sandwich structure of molybdenum disulfide and graphene oxide on a first component;

moving the first component against a steel component with a slide-to-roll ratio of 2-7%, the steel component comprising stainless steel; and forming a tribolayer on the steel component;

wherein one of the first component and the steel component is a ball.

2. The method of claim 1, wherein the tribolayer is formed from at least one of transformation of GO to amorphous carbon and shearing of $MoS_2$.

3. The method of claim 1, further comprising establishing a dry nitrogen environment over the substrate.

4. The method of claim 1, wherein disposing over the substrate the solution comprises spraying a liquid containing 1-2 g/L in a carrier media in a 1:1 ratio onto the substrate.

5. The method of claim 4, wherein the carrier media is ethanol or water.

6. The method of claim 1, wherein the slide-to-roll ratio is 2% to 5%.

7. The method of claim 1, wherein moving the first component relative to the steel component is in the absence of a liquid lubricant.

8. The method of claim 1, wherein the steel component is free of diamond- or nanodiamond-like materials.

9. The method of claim 1, wherein the steel component has a surface roughness ($R_a$) of between of 200~350 nm.

10. The method of claim 1, wherein the steel component has a surface roughness ($R_a$) of 215±15 nm.

11. A low friction apparatus comprising:

a first component having a substrate and further having molybdenum disulfide ($MoS_2$) and graphene oxide (GO) disposed over the substrate;

a second component having a substrate comprising steel with a surface roughness ($R_a$) of between of 200~300 nm; and the first component and the second component in mechanical communication with a slide-to-roll ratio of 2-7%;

wherein the mechanical communication between the first component and the second component forms a tribolayer on the second component.

12. The low friction wear surface of claim 11, wherein the first component has a GO to $MoS_2$ or 1:1 ratio.

13. The low friction wear apparatus of claim 11, wherein the tribolayer comprises amorphous carbon.

14. The low friction wear apparatus of claim 11, wherein the substrate comprises at least a portion of a bearing, mold, razor blade, wind turbine, gun barrel, gas compressor, fuel cell, artificial hip joint, artificial knee joint, magnetic storage disk, mechanical shaft seals, metal forging dies, plastic injection molding dies, mechanical latch, scratch-free monitor, scratch-resistant monitor, television, barcode scanner, solar panel, watch, mobile phone, computer or electrical connector.

15. The low friction wear apparatus of claim 11 wherein the low friction wear surface has a coefficient of friction of less than about 0.01 with the stainless steel countersurface.

16. A method of forming a low friction wear surface comprising:

suspending solid $MoS_2$ and GO in a solvent to form a solution of at least 1-10 g/L solids;

depositing the solution on a substrate in a dry, inert environment;

evaporating the solvent;

forming a coated substrate having a coating of the solid components 100-1000 nm thick;

engaging the coated substrate with a steel component with relative movement having a slide-to-roll ratio is 2% to 5%; and forming a tribolayer on the steel component by one or more of one of transformation of GO in the coating of solid components to amorphous carbon and shearing of $MoS_2$ in the coating of solid components.

17. The method of claim 16, wherein the solution comprises a 1:1 ratio of molybdenum disulfide ($MoS_2$) to graphene oxide (GO).

18. The method of claim 16, wherein the steel component has a surface roughness ($R_a$) of between ~200 nm and ~350 nm.

19. The method of claim 16, wherein the steel component has a surface roughness ($R_a$) of 300±20 nm.

20. The method of claim 1, further comprising forming from the layered-sandwich structure of molybdenum disulfide and graphene oxide on the first sliding component, a first sliding component tribological layer comprising amorphous carbon.

* * * * *